US008739468B2

(12) United States Patent
Yamaguchi et al.

(10) Patent No.: US 8,739,468 B2
(45) Date of Patent: Jun. 3, 2014

(54) DOOR OPENING AND CLOSING DEVICE

(75) Inventors: Koushi Yamaguchi, Tokyo (JP); Kazuaki Kashiwaguma, Tokyo (JP); Mitsuru Sugiura, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 13/391,536

(22) PCT Filed: May 14, 2010

(86) PCT No.: PCT/JP2010/058169
§ 371 (c)(1),
(2), (4) Date: Mar. 29, 2012

(87) PCT Pub. No.: WO2011/021414
PCT Pub. Date: Feb. 24, 2011

(65) Prior Publication Data

US 2012/0317883 A1 Dec. 20, 2012

(30) Foreign Application Priority Data

Aug. 20, 2009 (JP) ..... 2009-191099

(51) Int. Cl.
*E05F 1/00* (2006.01)

(52) U.S. Cl.
USPC ..... 49/379; 312/319.2

(58) Field of Classification Search
USPC ..... 49/275, 276, 364, 379; 312/319.2, 333, 312/405
See application file for complete search history.

(56) References Cited

U.S. PATENT DOCUMENTS 3,724,134 A * 4/1973 Verdone ..... 49/379
4,369,545 A * 1/1983 Maublanc ..... 16/64

(Continued)

FOREIGN PATENT DOCUMENTS

JP 9-303038 11/1997
JP 2005-273199 10/2005

(Continued)

OTHER PUBLICATIONS

International Search Report, PCT/JP2010/058169, Jun. 29, 2010.

*Primary Examiner* — Katherine Mitchell
*Assistant Examiner* — Catherine A Kelly
(74) *Attorney, Agent, or Firm* — Young & Thompson

(57) ABSTRACT

Provided is a door opening and closing device wherein the device width can be made small and wherein the movement of a retraction arm can be stabilized. In a body case (102) which is slender and extends in one direction, there is provided an arm block (121) for a retraction arm (104) which rotates from the open state to the closed state. On one side of the body case (102), there is provided a first slider (134) which, being interlocked with the rotation of the arm block (121), makes linear movements in one direction. In the body case (102), there is provided an arm shaft (105) which serves as the center of rotation of the arm block (121). A second slider (131) which, being interlocked with the rotation of the arm block (121), makes linear movements in one direction, is provided opposite the first slider (134), in such a way as to have the arm shaft (105) held between the first and second sliders (134, 131). On one side of the body case (102), there is provided a force applying member (128) which applies force on the first slider (134) in one direction. On the opposite side of the body case (102), there is provided a damper which resists the linear movement of the second slider (131).

13 Claims, 23 Drawing Sheets

(56) References Cited

U.S. PATENT DOCUMENTS

| | | | | |
|---|---|---|---|---|
| 5,904,411 | A | 5/1999 | Hayakawa | |
| 2009/0320236 | A1* | 12/2009 | Yamamuro | 16/64 |
| 2010/0229341 | A1* | 9/2010 | Tomioka | 16/49 |
| 2011/0254292 | A1* | 10/2011 | Ishii | 292/341.15 |

FOREIGN PATENT DOCUMENTS

| | | |
|---|---|---|
| JP | 2006-200183 | 8/2006 |
| JP | 2009-084946 | 4/2009 |
| JP | 2009-114823 | 5/2009 |
| JP | 2010-095979 | 4/2010 |

* cited by examiner

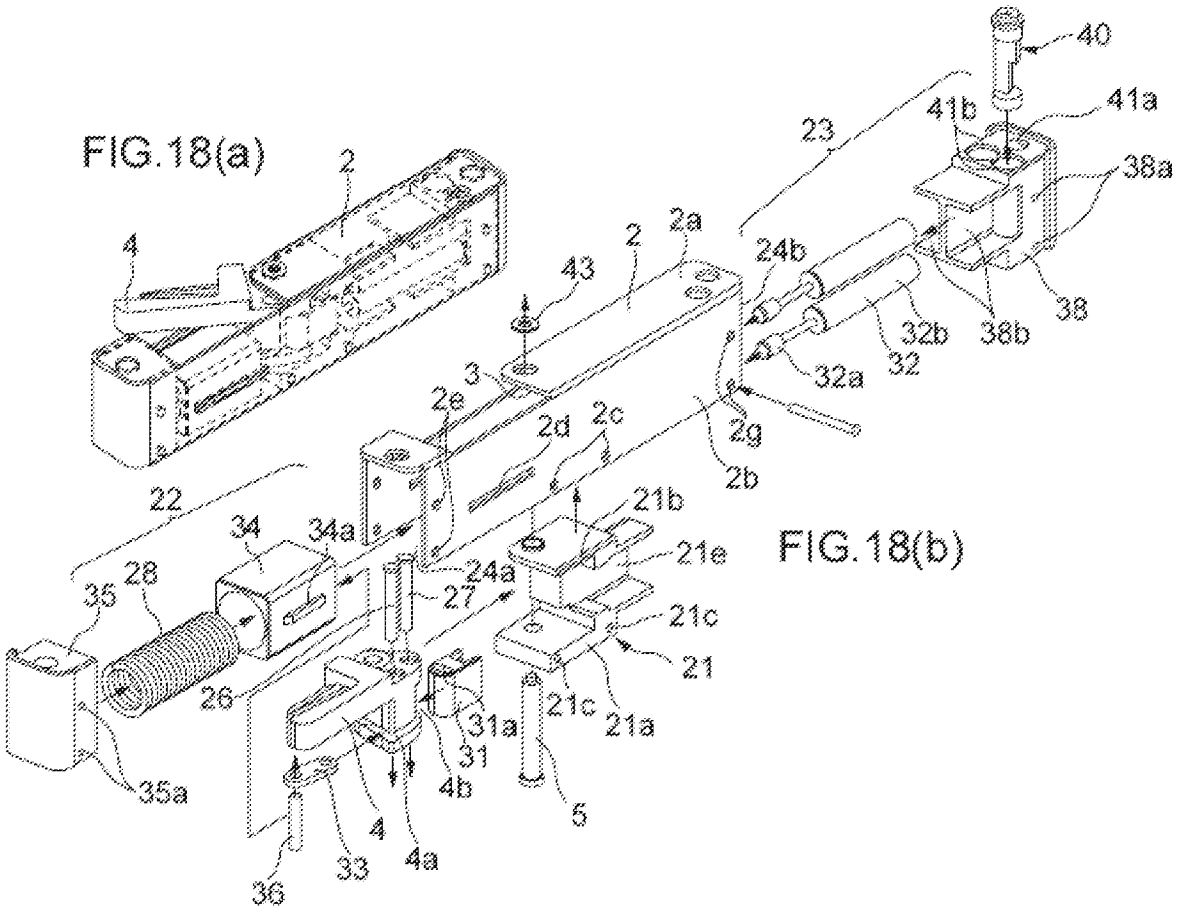
FIG.18(a)
FIG.18(b)
FIG.19
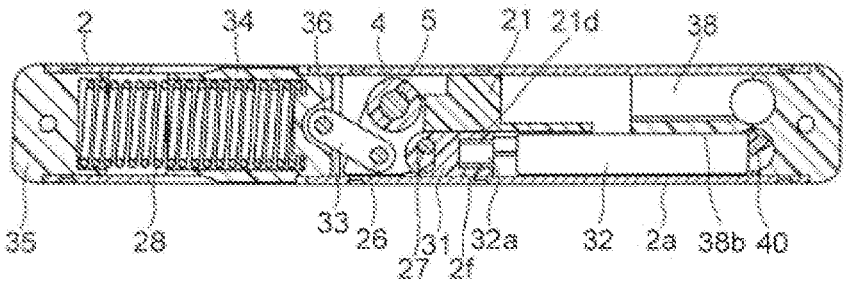

A-A cross section

B-B cross section

C-C cross section

A-A cross section

DOOR OPENING AND CLOSING DEVICE

TECHNICAL FIELD

The present invention relates to a door opening and closing device for assisting opening and closing of a door, such as a hinged door or a sliding door, of furniture or construction.

BACKGROUND ART

Furniture doors and construction doors can be classified into a hinged door type, a sliding door type or the like. The hinged door is a door that opens by rotating. The sliding door opens and closes by horizontally sliding on a frame composed of a head jamb and a doorsill.

In order to assist opening and closing of such a door, there is provided a door opening and closing device. The door opening and closing device is mounted on either a door or a frame surrounding the door, and cooperates with a catch, which is mounted on the other of the door and the frame, to attenuate impact when the door gets closed forcefully by wind or the like or to assist a half-open door to be closed completely.

As such a door opening and closing device, the patent literature 1 discloses a door opening and closing device for opening and closing a door with use of a rack and pinion mechanism in a main structure. When the door gets closed and the catch of the door abuts to a catcher member of the door opening and closing device, the catcher member catches the catch and retracts it to a retraction position. A force for the catcher member retracting the catch results from a spring force of a helical extension spring. The spring force of the helical extension spring is converted into a retraction force of the catcher member by the rack and pinion mechanism.

The patent literature 2 discloses a door opening and closing device for opening and closing a sliding door. In such a door opening and closing device, when the sliding door gets closed, a crank arm catches a catch of the sliding door and retracts the sliding door to a retraction position. A force for the crank arm retracting the sliding door results from a spring force of a helical extension spring connected to the crank arm. The helical extension spring is directly connected to the crank arm and gives the crank arm a force in the retracting direction.

CITATION LIST

Patent Literature

PL1: Japanese Patent Application Laid-Open No. 2009-84946

PL2: Japanese Patent Application Laid-Open No. 2009-114823

SUMMARY OF INVENTION

Technical Problem

However, the door opening and closing device disclosed in the patent literature 1 has a problem that it is likely to be upsized as the rack and pinion mechanism is used in the main structure. As it is upsized, the device cannot be embedded in the door. And the device is inevitably mounted on the door in an exposed manner, there arises a problem of bad looking.

The door opening and closing device disclosed in the patent literature 2 has a problem that the operation of the crank arm is unstable as it is directly connected to the helical extension spring. Besides, the helical extension spring rotates around its end in the longitudinal direction as the crank arm rotates. This causes a problem that the width of the door opening and closing device cannot be reduced. As the door opening and closing device is mounted on the frame or door, the door opening and closing device needs to have a smaller width.

The present invention was carried out to solve the problems of the conventional door opening and closing devices, and it aims to provide a door opening and closing device that is small in width and capable of stabilizing operation of a retractable arm.

Solution to Problem

In order to solve the above-mentioned problems, an aspect of the present invention is a door opening and closing device comprising: a body case elongated in one direction; a retractable arm which is provided rotatable in the body case and rotates from an open state to a closed state; a first slider which is provided at one side of the body case and moves linearly in the one direction in conjunction with rotation of the retractable arm; a second slider which is provided at an opposite side of the body case in such a way that an arm axis as a rotational center of the retractable arm is sandwiched between the first slider and the second slider and which moves linearly in the one direction in conjunction with rotation of the retractable arm; a biasing member which is provided at the one side of the body case and biases the first slider in the one direction; and a damper which is provided at the opposite side of the body case and resists linear movement of the second slider, wherein the biasing member gives the retractable arm in the open state a biasing force in an opening direction, and when the retractable arm in the open state is rotated in a closing direction by a predetermined angle or more, the biasing member gives the retractable arm a biasing force in the closing direction, and when the retractable arm is rotated in the closing direction, the damper damps rotation of the retractable arm.

Advantageous Effects of Invention

According to the present invention, the first slider is arranged at one side of the body case and the second slider is arranged at the other side in such away that the rotational axis of the retractable arm is sandwiched therebetween. With this arrangement, as the first and second sliders move linearly in one direction with rotation of the retractable arm, it is possible to reduce the width of the door opening and closing device and stabilize the operation of the retractable arm.

BRIEF DESCRIPTION OF DRAWINGS

FIG. 18 is an exploded perspective view of the door opening and closing device;

FIG. 19 is across sectional view of the door opening and closing device;

DESCRIPTION OF EMBODIMENTS

Figure 1:
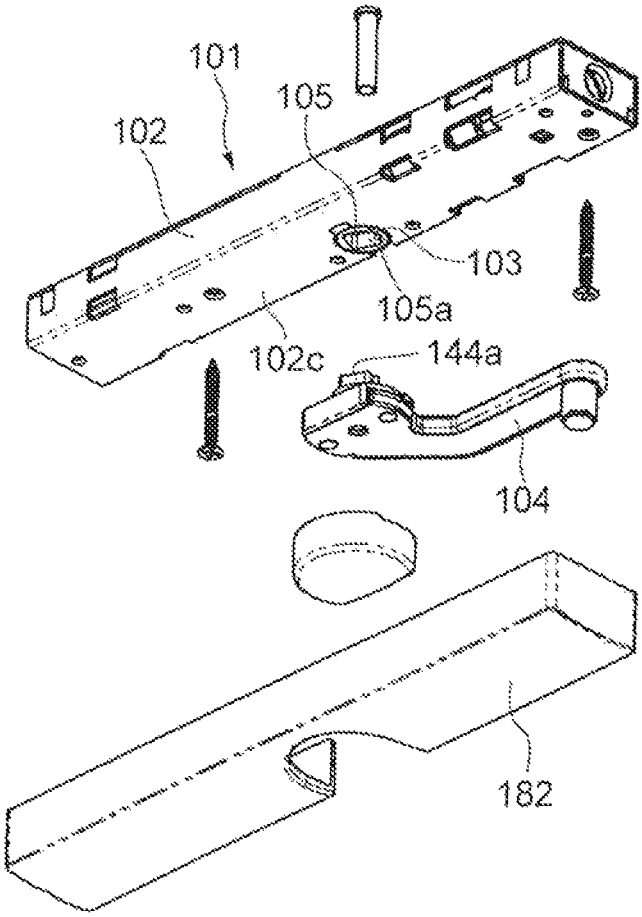
FIG. 1 is a perspective view illustrating appearance of a door opening and closing device according to one embodiment of the present invention.

With reference to the attached drawings, a door opening and closing device according to an exemplary embodiment of the present invention will be described in detail below. FIG. 1 is a perspective view illustrating appearance of the door opening and closing device. This door opening and closing device 101 is used to assist opening and closing of a door. A body case 102 is formed into a rectangular solid elongated in one direction. In a bottom plate part 102*c* of the body case 102, an arm axis hole 103 is formed. In this arm axis hole 103, an fit part 105*a* of an arm axis 105 is exposed, to which a fit part 144*a* of a retractable arm 104 is fit. The retractable arm 104 is rotatable in the horizontal direction around the arm axis 105. The body case 102 is covered with a cover 182.

Figure 2A:
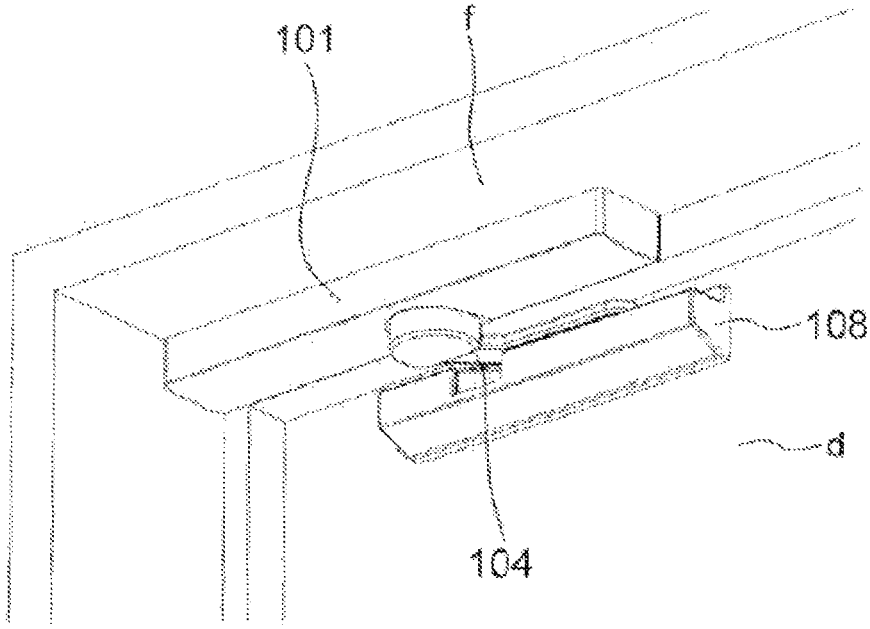
FIGS. 2(*a*) and 2(*b*) are perspective views illustrating appearance of the door opening and closing device mounted in a door (FIG. 2(*a*) illustrates a retractable arm in a closed state and FIG. 2(*b*) illustrates the retractable arm in a half-open state)
Figure 2B:
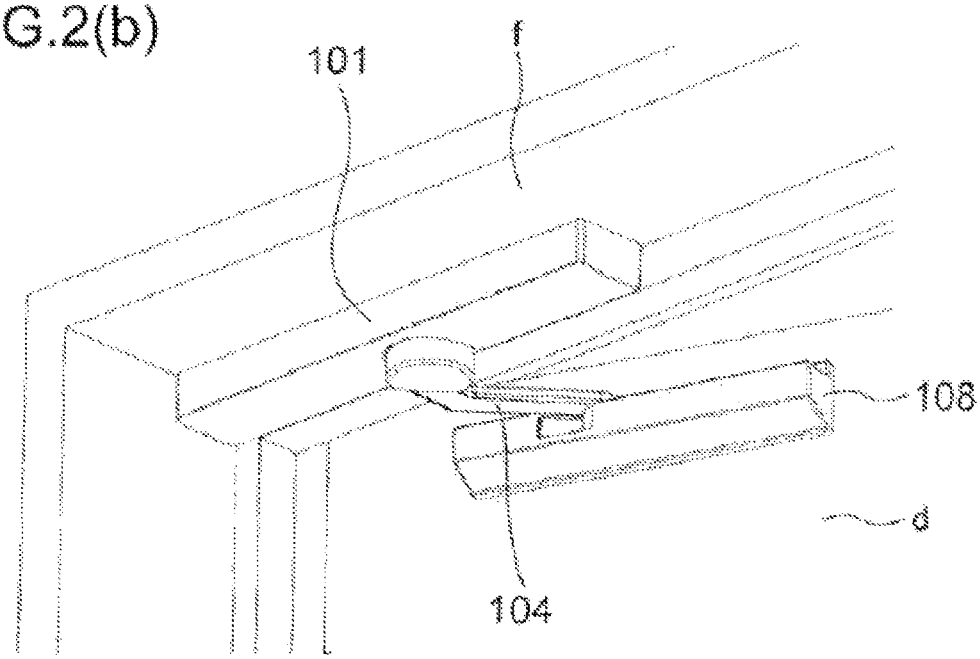

FIGS. 2(*a*) and 2(*b*) illustrate the door opening and closing device 101 mounted on the frame. FIG. 2(*a*) illustrates the retractable arm 104 of the door opening and closing device 101 which is closed and FIG. 2(*b*) illustrates the retractable arm 104 which is rotated from the closed state to the open state. As illustrated in FIG. 2(*a*), the door opening and closing device 101 is mounted in the bottom surface of the frame f. On a side surface of the door d, a catch 108 is fixed thereto. The catch 108 is connected to the door opening and closing device 101 by the retractable arm 104.

Figure 3:
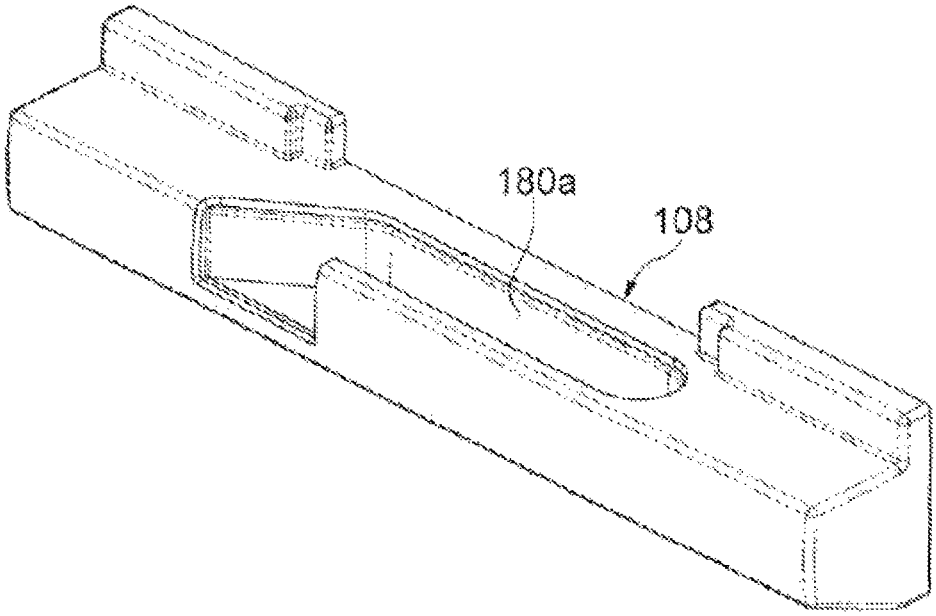
FIG. 3 is a perspective view illustrating appearance of a catch.
Figure 4:
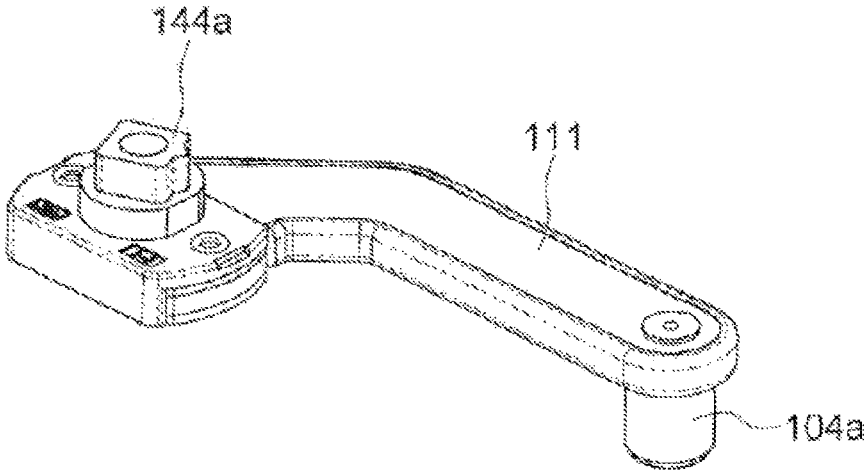
FIG. 4 is a perspective view illustrating appearance of the retractable arm.

FIG. 3 is a perspective view of the catch 108 which cooperates with the door opening and closing device 101. The catch 108 has a groove part 180*a*. When the door d opens or closes, a slide protrusion 104*a* (see FIG. 4) provided at the tip end of the retractable arm 104 opposite to the arm axis 105 is fit in the groove part 180*a* and slides, which gives an amount of rotation in accordance with the open or close degree of the door d to the door opening and closing device 101 via the arm axis 105.

When the door d is closed lightly, the door d sometimes does not close completely. However, as the slide protrusion 104*a* at the tip end of the retractable arm of the door opening and closing device 101 is fit in the groove part 180*a* of the catch 108 and the door opening and closing device 101 operates, the door d can close completely even when the door d is closed lightly. Besides, when the open door gets closed forcefully by wind or the like, the door opening and closing device 101 attenuates the impact on the door d so that the door d can get closed slowly. The door opening and closing device 101 acts not only to retract the door d, but also to allow slow movement of the door d.

Figure 5:
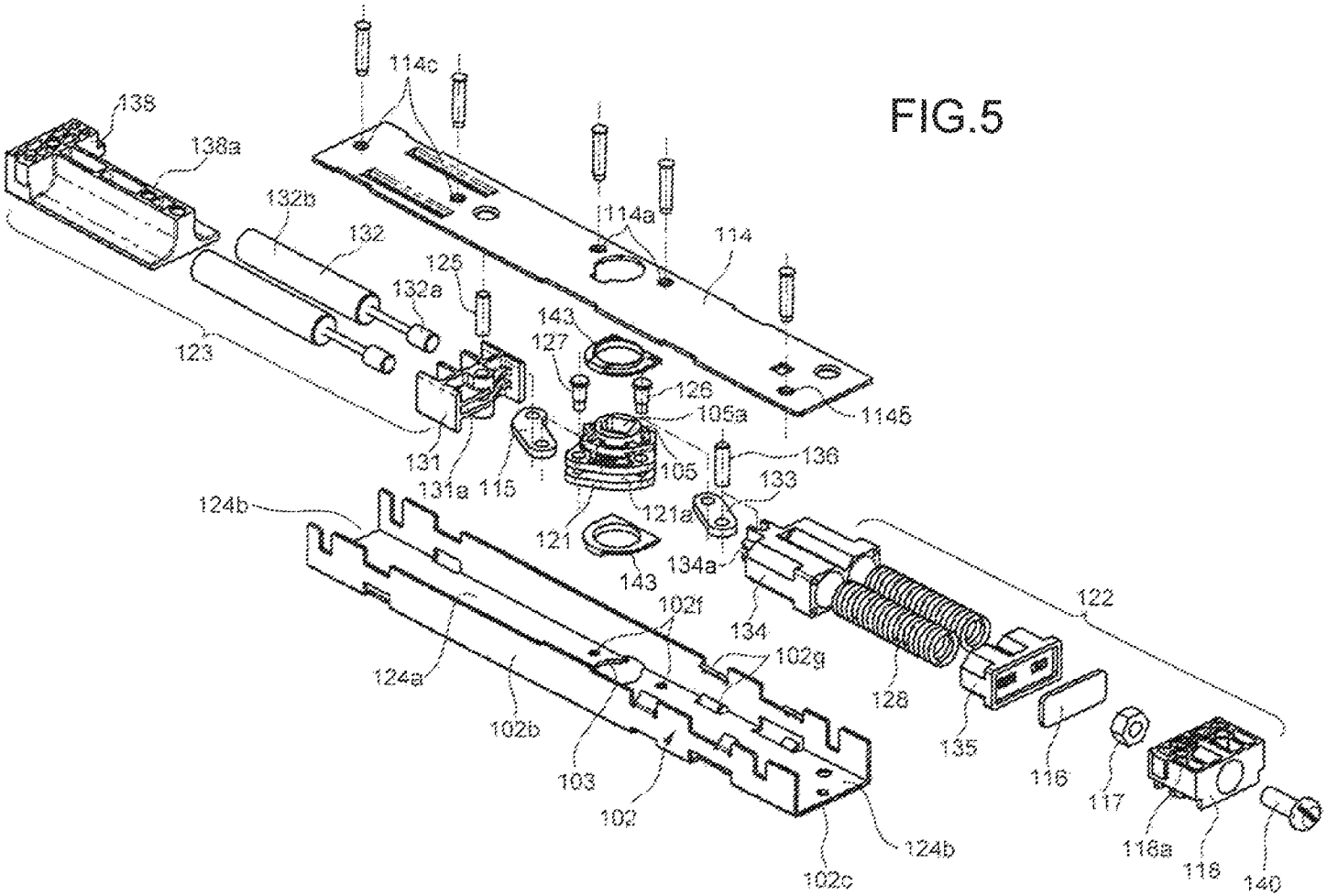
FIG. 5 is an exploded perspective view of the door opening and closing device.

FIG. 5 is an exploded perspective view of the door opening and closing device. The door opening and closing device 101 has the body case 102 elongated in one direction, an arm block 121 which is a part of the retractable arm 104 and built in the body case 102, a biasing mechanism 122 for applying a torque in the opening or closing direction of the door d to the arm block 121, and a damper mechanism 123 for attenuating the impact when closing the door. The arm block 121 is positioned at the center of the body case 102 in the longitudinal direction. The biasing mechanism 122 is positioned at one side of the body case 102 in the longitudinal direction and the damper mechanism 123 is positioned at the other side of the body case 102 in the longitudinal direction in such a way that the arm block 121 is sandwiched between the damper mechanism 123 and the biasing mechanism 122.

The outline structure of each part is described below. The body case 102 has a bottom plate part 102*c* and a pair of side wall parts 102*b*. The cross section of the body case 102 is U shaped. The body case 102 has an upper surface and end surfaces in the longitudinal direction, where openings 124*a*, 124*b* are formed for installation of parts. In the bottom plate part 102*c* of the body case 102, the arm axis hole 103 is formed for exposing the fit part 105*a* in which the retractable arm 104 is fit. This body case 102 is manufactured by sheet metal processing of bending a thin plate.

The arm block 121 is a central part from structural and assembly points of view. The arm block 121 has a cylindrical arm axis 105 at the center. The arm axis 105 has the fit part 105*a* at the center, which is an approximately square-shaped hole. Around the arm axis 105, holes are formed at off-center positions of the arm axis 105 for insertion of a first link shaft 126 and a second link shaft 127. At upper and lower ends of the arm block 121, bearing plates 143 are provided. Each of the bearing plate 143 has a hole formed therein, in which the outer peripheral part of the arm axis 105 is inserted. The arm block 121 is rotatable relative to the bearing plates 143. The bearing plates 143 are fixed by inserting rivets into arm base mounting holes 102*f* and 114*a* formed in the body case 102 and case cover 114.

The retractable arm 104 has a retractable arm main body 111 (see FIG. 4) and the arm block 121. The retractable arm main body 111 has the fit part 144*a* (see FIG. 4) at the rotational axis part, which takes a square form. The retractable arm main body 111 is fit in the fit part 105*a* at the center of the arm axis 105 and rotates with the arm axis 105. In the arm block 121, the first link shaft 126 and the second link shaft 127 are inserted at off-center positions of the arm axis 105. On the first link shaft 126, a force of the compression spring 128 of the biasing mechanism 122 is always applied thereto. With this spring force of the compression spring 128, a force for retracting the door d acts on the pulling force 104 via the arm block 121. The second link shaft 127 is connected to a slide block 131 of a damper mechanism 123. When the retractable arm 104 rotates in the closing direction, the slide block 131 pushes the head of a rod 132*a* of a damper 132. Therefore, even when the retractable arm 104 tries to rotate quickly in the closing direction, the damper 132 damps rotation of the retractable arm 104.

As illustrated in FIG. 5, the biasing mechanism 122 has the first link shaft 126, a first link 133, a spring linking shaft 136, a slide spring case 134 as a first slider, a compression spring 128 as an elastic member, a spring catch 135, position adjusting means for adjusting the position of the spring catch 135, and a spring base 118. The position adjusting means has an adjusting plate 116, an adjusting screw 140 and an adjusting nut 117.

The slide spring case 134 is movable linearly in the longitudinal direction of the body case 102 and linear movement of the slide spring case 134 is guided by the inner wall surface of the body case 102. The slide spring case 134 moves linearly in the longitudinal direction in conjunction with rotation of the retractable arm 104. In the body case 102, a claw 102*g* is formed for guiding the linear movement of the slide spring case 134 and restricting the stroke of the slide spring case to fall within a predetermined distance.

The first link 133 is connected rotatable to the arm block 121 and the slide spring case 134. Two holes are formed at the off-center positions of the arm axis 105 of the arm block 121. In one of the holes, the first link shaft 126 is inserted into the first link 133 from above so that the first link 133 is connected to the arm block 121. At the other end of the first link 133, the spring linking shaft 136 is fit therein. This spring linking shaft 136 is used to connect the slide spring case 134 to the first link 133.

This arm block 121 has a slit 121*a* around the link shaft 126, and the slide spring case 134 also has a slit 134*a*. The slits 121*a* and 134*a* are equal in height. As the first link 133 is fit to the slide 121*a* and 134*a* and mounted, it can rotate in the horizontal plane in a stable manner.

In the slide spring case 134, a large hole is formed of which the diameter is slightly larger than the diameter of the compression spring 128. The compression spring 128 is placed in this hole. The compression spring 128 biases the slide spring case 134 toward the arm block 121. At the opposite side of the compression spring 128 to the slide spring case 134, a spring catch 135 is arranged with a hole of which the diameter is slightly larger than the diameter of the compression spring 128. The compression spring 128 is compressed between the slide spring case 134 and the spring catch 135. The spring catch 135 has the adjusting plate 116 at the opposite side to the compression spring 128. The biasing force of the compression spring 128 is received via the adjusting plate 116 and adjusting screw 140, finally by the spring base 118. The spring base 118 is fixed to the end of the body case 102 via a rivet, screw or the like. The spring base 118, the body case 102 and the case cover 114 have mounting holes 118*a*, 102*e* (not shown) and 114*b* for connecting of the spring base 118.

The position of the spring catch 135 in the longitudinal direction of the body case 102 is adjustable by turning the adjusting screw 140 mounted on the spring base 118 with the adjusting nut 117, which enables to adjust a biasing force of the compression spring 128.

This damper mechanism 123 has a second link shaft 127, a second link 115, a damper linking shaft 125, a slider block 131 as a second slider, a damper 132 and a damper base 138.

The slide block 131 is movable linearly in the longitudinal direction of the body case 102. Linear movement of the slide spring case 134 is guided by the inner wall surface of the body case 102. The slide block 131 moves linearly in the longitudinal direction in conjunction with rotation of the retractable arm 104.

The second link 115 is connected rotatable to the arm block 121 and the slide block 131. Out of two holes formed at off-center positions of the arm axis 105 of the arm block 121, the first link shaft 126 passes through one hole and the second link shaft 127 passes through the other hole and the second link 115 so that the second link 115 is linked to the arm block 121. At the other end of the second link 115, a damper linking shaft 125 is fit therein. This damper linking shaft 125 is used to connect the slide block 131 to the second link 115. Then, the slit 121*a* provided in the arm block 121 extends around the link shaft 127 and the slide block 131 also has a slit 131*a*. The slits 121*a* and 131*a* are equal in height. The second link 115 is mounted by engagement between the slits 121*a* and 131*a* so that it can rotate in the horizontal plane stably.

The damper 132 used here is an extendable damper of which a rod 132*a* moves relative to a main body 132*b*. When the rod 132*a* contracts relative to the main body 132*b*, a damping force is generated against the movement of the rod 132*a*. In this example, two, right and left, dampers 132 are used in combination.

At ends of the body case 102 and the case cover 114, the damper base 138 is connected with use of a rivet, screw or the like. In the damper base 138, the body case 102 and the case cover 114, mounting holes 138*a*, 114*c* are formed for connection of the damper base 138. The damper base 138 acts as a holding member of the dampers 132.

Figure 6A:
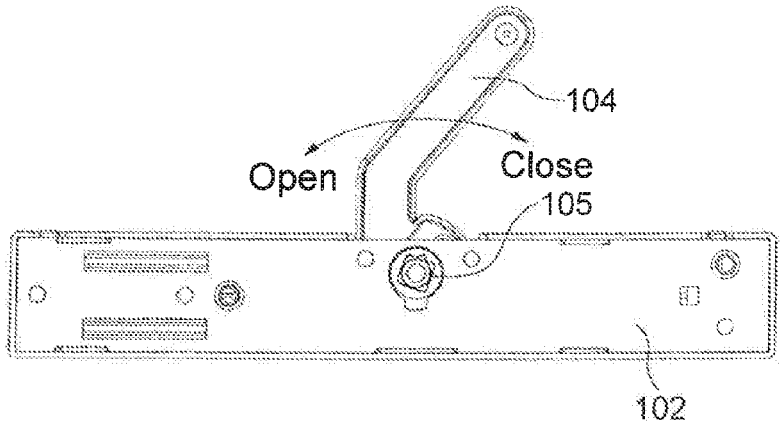
FIGS. 6(*a*) to 6(*c*) are operational diagrams of the door opening and closing device (FIG. 6(*a*) illustrates the retractable arm in the closed state, FIG. 6(*b*) illustrates the retractable arm in the half-open state and FIG. 6(*c*) illustrates the retractable arm in the open state)
Figure 6B:
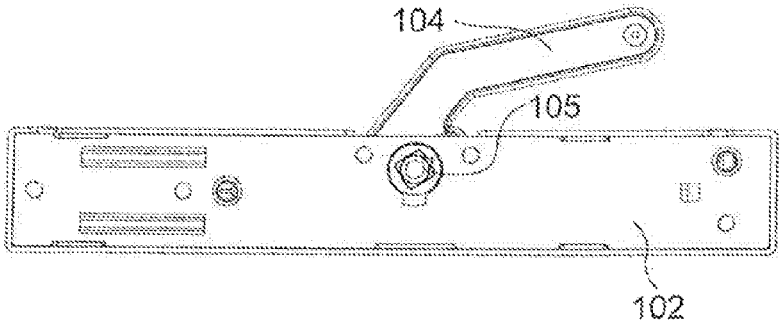
Figure 6C:
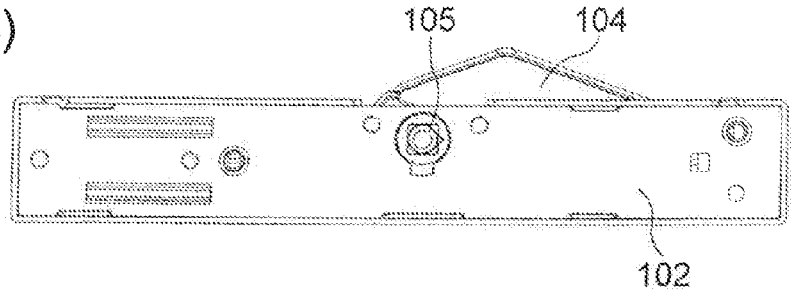
Figure 7A:
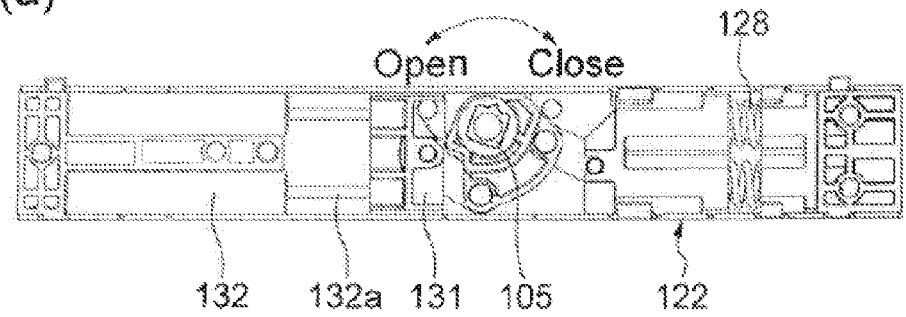
FIGS. 7(*a*) to 7(*c*) are cross sectional views of the door opening and closing device during operation (FIG. 7(*a*) illustrates the retractable arm in the closed state, FIG. 7(*b*) illustrates the retractable arm in the half-open state and FIG. 7(*c*) illustrates the retractable arm in the open state)
Figure 7B:
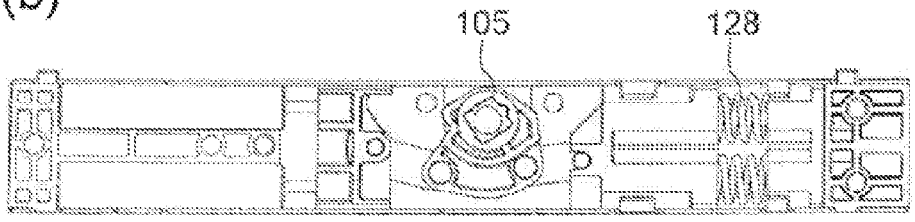
Figure 7C:
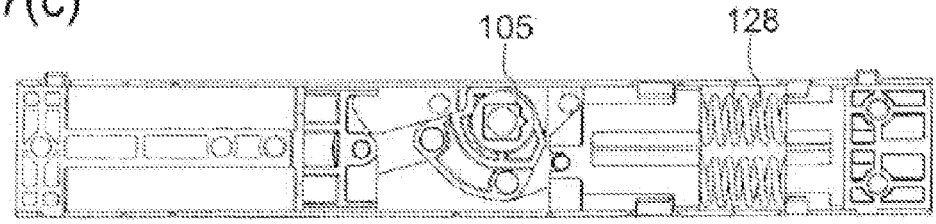
Figure 8:
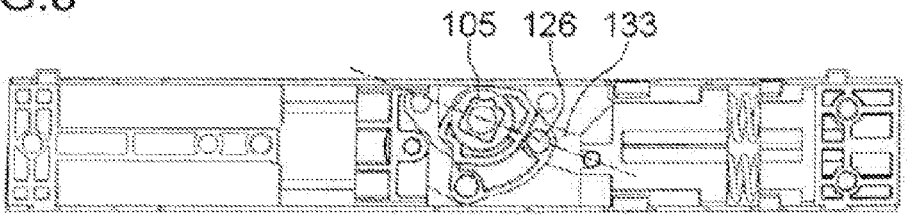
FIG. 8 is a cross sectional view of the door opening and closing device at a change point.

The operation of the door opening and closing device 101 is as follows. The retractable arm 104 rotates from the open state as illustrated in FIG. 6(*a*) to the closed state as illustrated in FIG. 6(*c*). FIGS. 7(*a*) to 7(*c*) are cross sectional views correspond to FIGS. 6(*a*) to 6(*c*), and the retractable arm 104 is omitted in FIGS. 7(*a*) to 7(*c*). When the retractable arm 104 is in the open state, the retractable arm 104 is given a torque further in the opening direction by a spring force of the compression spring 128 of the biasing mechanism 122. Therefore, the retractable arm 104 is kept in the open state. When the retractable arm 104 is rotated in the closing direction against the spring force of the compression spring 128, it reaches a change point of the biasing mechanism 122. The retractable arm 104 is further rotated in the opening direction. Then, when it passes by the change point of the biasing mechanism 122, as illustrated in FIG. 7(*c*), the retractable arm 104 is given a torque in the closing direction by the spring force of the compression spring 128. This enables to close the door d automatically. In addition, in conjunction with rotation of the retractable arm 104 in the closing direction, the slide block 131 pushes the heads of the rods 132*a* of the dampers 132. This enables slow rotation of the retractable arm 104. As illustrated in FIG. 8, at the change point, the line connecting the arm axis 105 to the first link shaft 126 coincides with the direction in which the first link 133 extends, and no force is generated for rotating the retractable arm 104.

When the retractable arm 104 is rotated in the closing direction, the slide block 131 abuts to the head of the rod 132*a* of the damper 132 and the damper 132 resists the linear movement of the slide block 131. On the other hand, when the retractable arm 104 is rotated in the opening direction, the slide block 131 goes away from the head of the rod 132*a* of the damper 132 so that the damper 132 does not resist linear movement of the slide block 131. This is because no resistance is preferable when opening the door d. As illustrated in FIG. 7, the slide block 131 is not connected to the head of the rod 132*a* of the damper 132 and the head of the rod 132*a* is merely placed in the slide block 131. The body case 102 and the damper base 138 guide the slide block 131 and the damper 132 so as to prevent play of the slide block 131 and the damper 132 when the slide block 131 is separated from the damper 132.

When opening the door d in the closed state as illustrated in FIG. 7(*c*), the retractable arm 104 is rotated in the counterclockwise direction. As illustrated in FIG. 7(*b*), when passing by the change point of the biasing mechanism 122, the retractable arm 104 is given a torque in the opening direction by the spring force of the compression spring 128.

The door opening and closing device 101 is assembled in the following manner. First, as illustrated in FIG. 5, the first link 133 is inserted into the slit 121*a* of the arm block 121, and the first link shaft 126 is inserted into the arm block 121 from above to connect the first link 133 to the arm block 121. Next, the second link 115 is inserted into the slit 121*a* of the arm block 121 and the second link shaft 127 is inserted into the arm block 121 from above to connect the second link 115 to the arm block 121.

Then, a pair of bearing plates 143 is used to sandwich the arm axis 105 of the arm block 121 vertically and the arm block 121 is placed in the body case 102.

Next, the first link 133 is inserted into the slit 134*a* of the slide spring case 134 and the spring linking shaft 136 is fit from above. Likewise, the second link 115 is inserted into the slit 131*a* of the slide block 131 and the damper linking shaft 125 is fit from above. Then, the case cover 114 is fit to the body case 102 from above, a rivet passes through the arm base mounting hole 114*a* and the arm block 121 assembled with the spring case 134 and slide block 131 is riveted to the body case 102.

Next, the compression spring 128 is inserted into the opening 124*b* of the body case 102, the spring catch 135 and the adjusting plate 116 follow to be inserted, the spring base 116 with the adjusting screw 140 and the adjusting nut 117 mounted thereon is inserted finally, the rivets are inserted into the spring base mounting holes 114*b*, 118*a*, 102*e*, and the biasing mechanism 122 is riveted to the body case 102.

Further, the two dampers 132 are inserted into the other opening 124*b* of the body case 102, the damper base 138 follows to be inserted, rivets are inserted into the damper base mounting holes 114*c*, 138*a*, 102*g* and the damper mechanism 123 is riveted to the body case 102.

With these steps, all the parts are assembled. As an assembly of the first link 133 and the slide spring case 134, and an assembly of the second link 115 and the slide block 131 are assembled to the arm block 121 in advance and then, the arm block 121 is assembled to the body case 102, the assembly work can be simplified. Only three parts, that is, the arm block 121, the spring case 118 and the damper base 138 are assembled to the body case 102.

Figure 9:
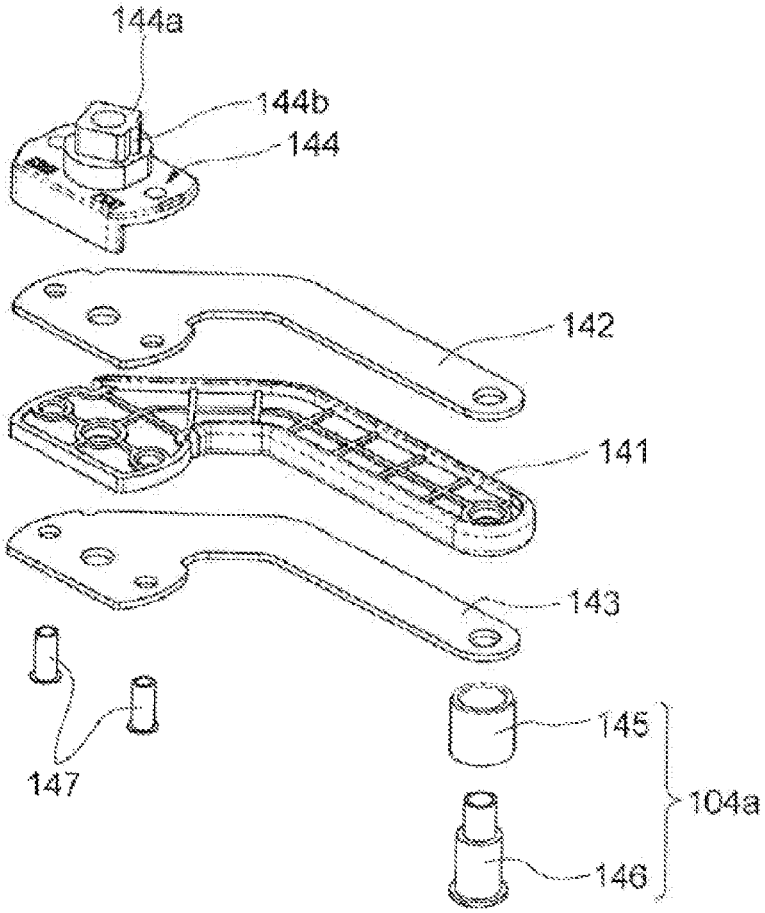
FIG. 9 is an exploded view of the retractable arm.

The detail structures of the catch 108 and the retractable arm 104 are described below. FIG. 9 is an exploded view of the retractable arm 104. The retractable arm 104 has an axis part 144 with the fit part 144*a* for fitting to the arm block 121, an intermediate plate 141, arm plates 142, 143 of identical shape to the intermediate plate 141, an arm roller 145 and a roller pin 146 provided at the tip end of the retractable arm 104. They are formed into one piece by rivets 147 and the roller pin 146. The fit part 144*a* is of approximately rectangular shape and has protrusions 144*b* for positioning when it is fit to the arm block 121. This structure prevents mismatch between the predetermined operation of the door opening and closing device 101 and the opening and closing operation of the door d. The arm roller 145 slides in the groove part 180*a* of the catch 108 with opening and closing of the door d. The arm roller 145 is mounted on the intermediate plate 141 rotatable by the roller pin 146. With this structure, the arm roller 145 can slide smoothly in the groove part 180*a* of the catch 108.

Figure 10:
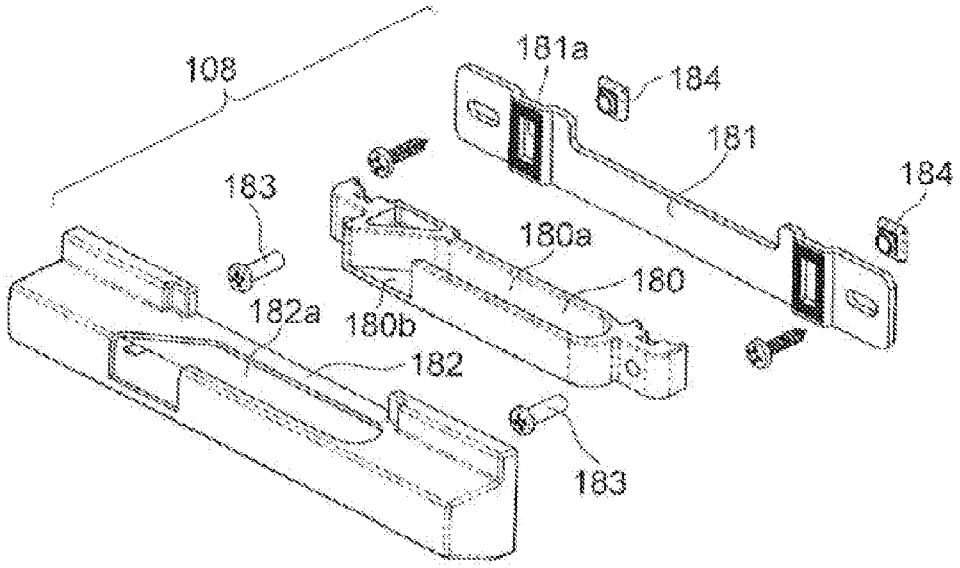
FIG. 10 is an exploded view of the catch.

FIG. 10 is an exploded view of the catch 108. A mounting stay 181 is fixed to the door d and a catch main body 180 is fixed to the mounting stay 181 via a long hole 181*a* by a catch mounting nut 184 and a catch mounting screw 183. The catch main body 180 and the mounting stay 181 have serrations at contact surfaces thereof (filled in black in the figure). The long hole 181*a* is used to adjust the mounting position of the catch main body 180 relative to the door d vertically. The catch cover 182 is fit to the catch main body 180. The catch cover 182 has a notch 182*a* that is little larger than the groove part 180*a* so as not to prevent movement of the retractable arm 104.

After the door opening and closing device 101 and the catch 108 are mounted on the frame f and the door d, respectively, the door d is opened fully and the retractable arm 104 is rotated to the full open state. Then, when the door d is to be closed, the slide protrusion 104*a* at the tip end of the retractable arm 104 is slid in the groove part 180*a* by being guided by the notch 180*b* of the catch 108 and the door opening and closing device 101 starts to operate.

If the retractable arm 104 is set in the closed state unnecessarily, in error, though the door d is open, the retractable arm. 104 is rotated to the full open state and thereby the door opening and closing device 101 can operate normally.

Figure 11A:
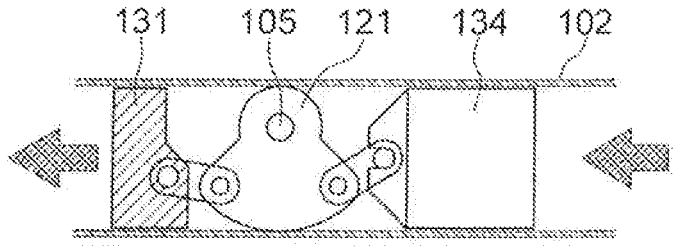
FIGS. 11(*a*) and 11(*b*) are schematic diagrams of an arm base, a biasing mechanism and a damper mechanism (FIG. 11(*a*) illustrates sliders used in the biasing mechanism and the damper mechanism, and FIG. 11(*b*) illustrates no slider used only in the biasing mechanism)
Figure 11B:
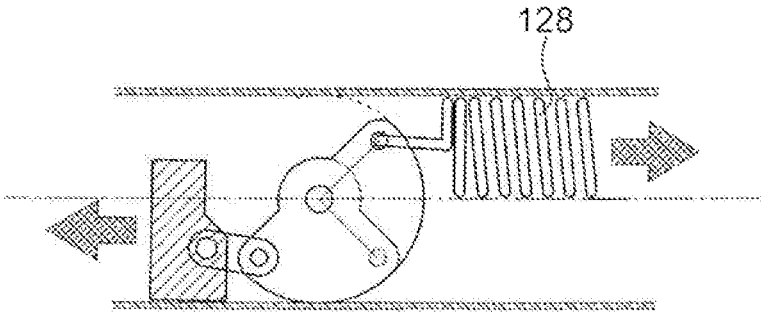

Following description is made, with reference to the drawings, about the reason why the first and second sliders are built in the biasing mechanism 122 and the damper mechanism 123. FIG. 11(*a*) is a schematic view illustrating the biasing mechanism 122 and the damper mechanism 123 using the sliders and FIG. 11(*b*) is a schematic view illustrating the biasing mechanism 122 using no slider.

As illustrated in FIG. 11(*a*), when the first slider (slide spring case) 134 is used in the biasing mechanism 122 and the second slider (slide block) 131 is used in the damper mechanism 123, it is possible to arrange the center of the arm block 121, the center of the first slider 134 and the center of the second slider 131 in one straight line. On the other hand, if the first slider 134 is not used in the biasing mechanism 122, the compression spring 128 that generate the biasing force needs to be mounted directly on the arm block 121, and as illustrated in FIG. 11(*b*), the center of the compression spring 128 needs to be offset from the arm axis 105. In this structure, the width (up and down direction in the figure) of the body case 102 is inevitably larger than the width of the body case when the slider is used as illustrate in FIG. 11(*a*). Accordingly, in order to reduce the width of the body case 102, the slider needs to be provided in each of the biasing mechanism 122 and the damper mechanism 123.

Figure 12A:
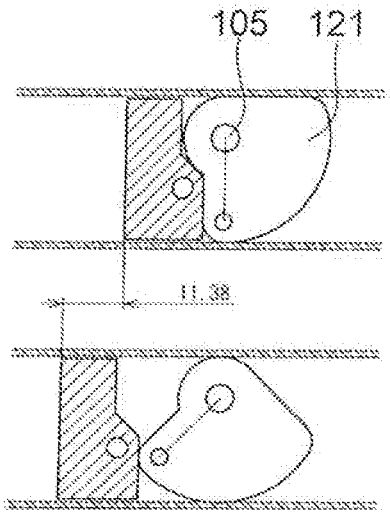
FIGS. 12(*a*) and 12(*b*) are schematic diagrams of stroke of the slider (FIG. 12(*a*) illustrates the case of using no link and FIG. 12(*b*) illustrates the case of using a link)
Figure 12B:
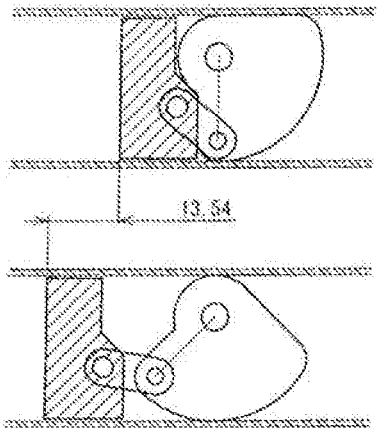

Next, the reason why the link is used in the slider is explained with use of the drawings. FIG. 12(*a*) illustrates a stroke of the slider when a cam mechanism is provided in the arm block 121 without use of the link, and FIG. 12(*b*) illustrates a stroke of the slider when the link is used. In FIGS. 12(*a*) and 12(*b*), the radius and the rotational angle of the arm axis 105 are the same.

As illustrated in FIGS. 12(*a*) and 12(*b*), as the link is used, the stroke of the slider can be increased by a length of the link. As the stroke of the slider is long, the biasing force of the biasing mechanism 122 can be increased, and the resistance of the damper mechanism 123 can be also increased, thereby facilitating assisting of the opening and closing of the door.

Next description is made in detail about a second embodiment.

Figure 13:
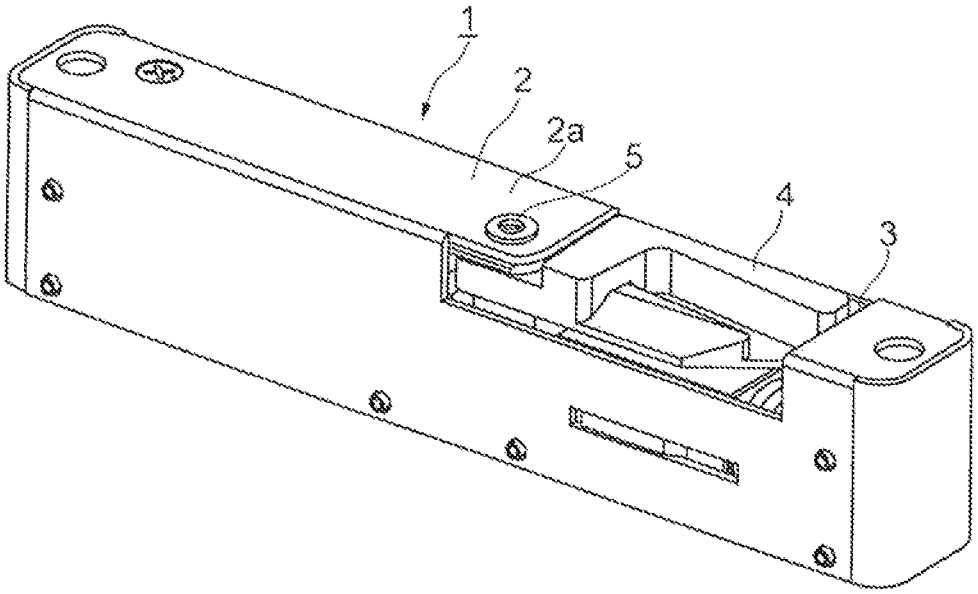
FIG. 13 is a perspective view illustrating appearance of a door opening and closing device according to a second embodiment of the present invention.

FIG. 13 is a perspective view illustrating appearance of a door opening and closing device. This door opening and closing device 1 is also used to assist opening and closing of the door. A body case 2 is formed into a rectangular solid elongated in one direction. At a ceiling part 2*a* of the body case 2, a notch 3 is formed, in which a retractable arm 4 is arranged. The retractable arm 4 is rotatable in the horizontal plane around an arm axis 5 and is exposed at the notch 3 (see FIG. 14).

Figure 14A:
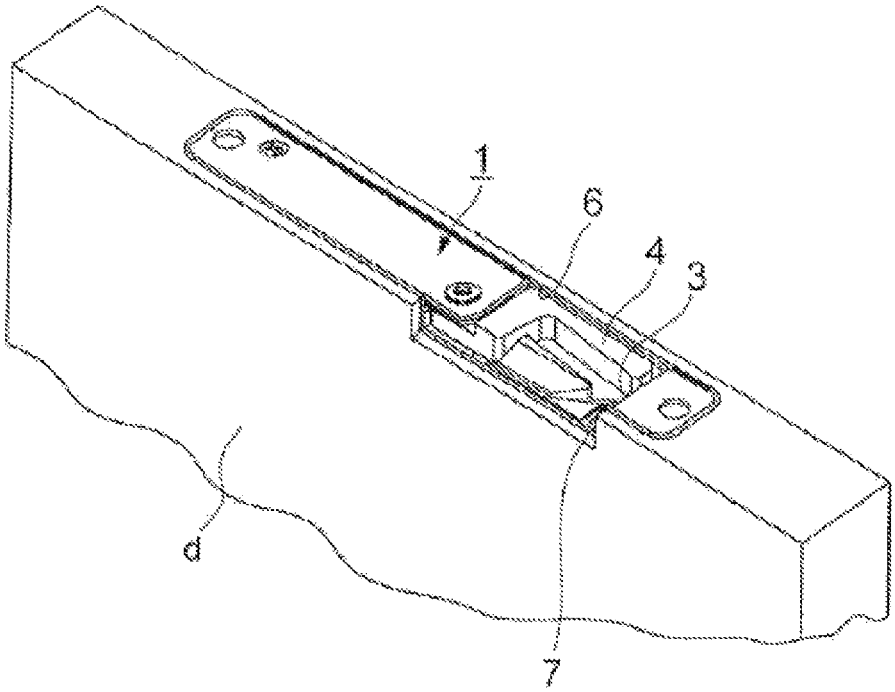
FIGS. 14(*a*) and 14(*b*) are perspective view illustrating appearance of the door opening and closing device embedded in the door (FIG. 14(*a*) illustrates a retractable arm in the closed state and FIG. 14(*b*) illustrates the retractable arm that is in the half-open state)
Figure 14B:
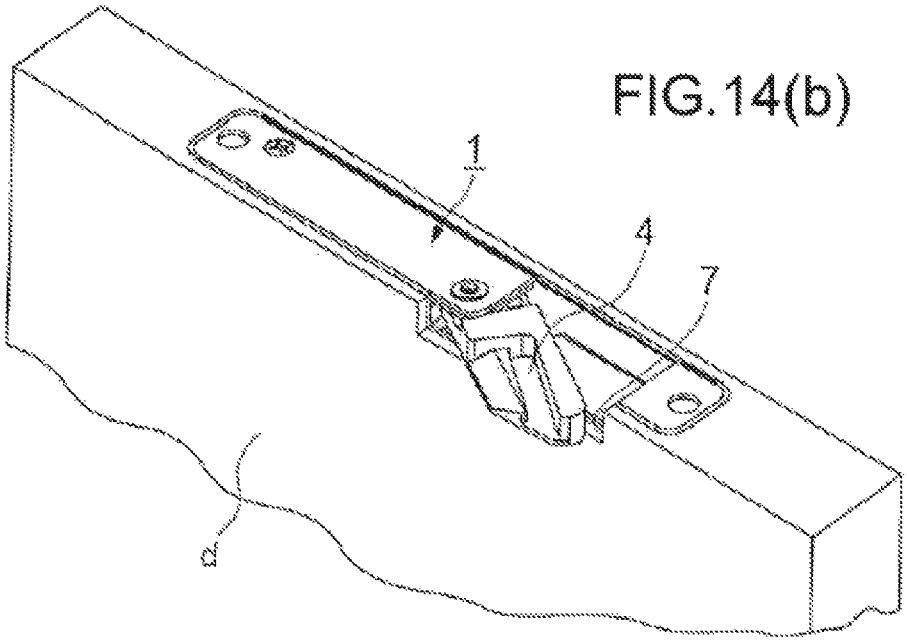

As illustrated in FIG. 14(*a*), in the upper surface of the door d, a box-shaped hole 6 is formed corresponding to the outer shape of the body case 2, and the door opening and closing device 1 is recessed in the hole 6. In the upper surface of the door d, a notch 7 is formed for exposing the retractable arm 4 at the position corresponding to the notch 3 of the body case 2. FIG. 14(*a*) illustrates the retractable arm 4 in the closed state. FIG. 14(*b*) illustrates the retractable arm 4 which is rotated from the closed state and exposed at the notch 7 of the door d.

Figure 15:
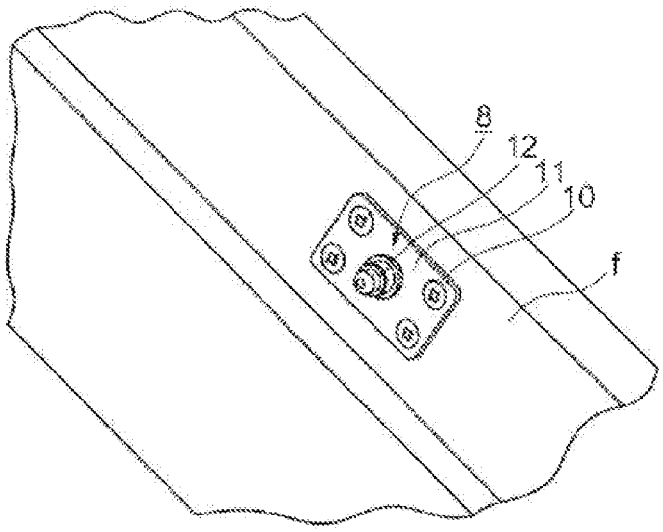
FIG. 15 is a perspective view of a catch mounted on the bottom surface of a frame.
Figure 16A:
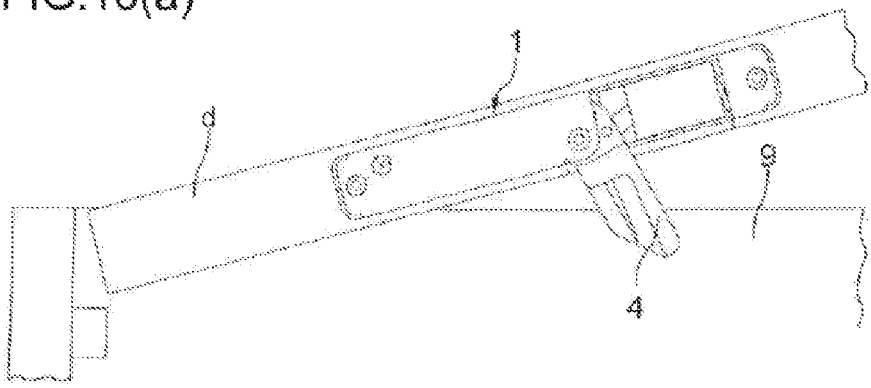
FIGS. 16(*a*) and 16(*b*) are views illustrating operations of the door opening and closing device when the door opens and closes (FIG. 16(*a*) illustrates the door being closed to catch the catch shaft by the retractable arm, and FIG. 16(*b*) illustrates the door closed)
Figure 16B:
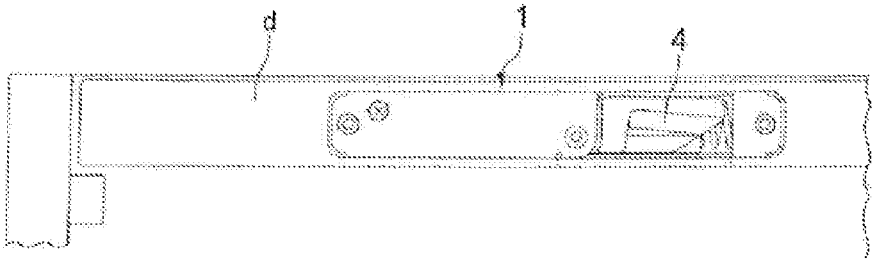
Figure 17A:
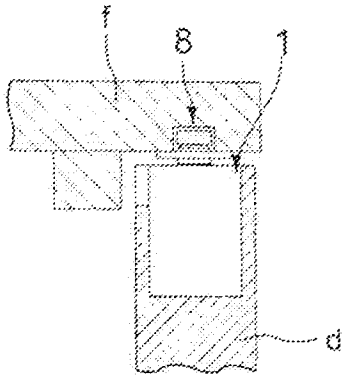
FIGS. 17(*a*) to 17(*d*) illustrate the door opening and closing device mounted in the door and the catch mounted in the frame (FIG. 17(*a*) is a side view, FIG. 17(*b*) is a front view, and FIGS. 17(*c*) and 17(*d*) are cross sectional views corresponding to FIGS. 17(*a*) and 17(*b*), respectively)
Figure 17B:
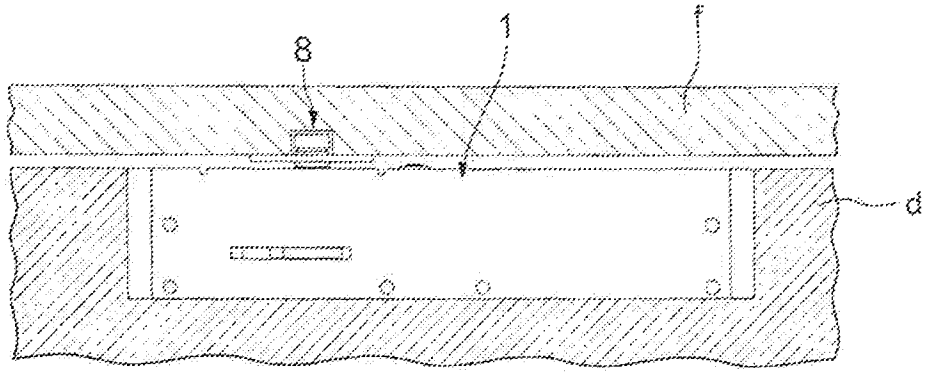
Figure 17C:
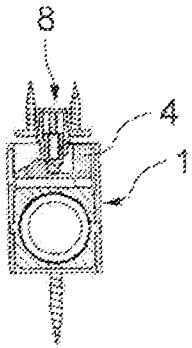
Figure 17D:
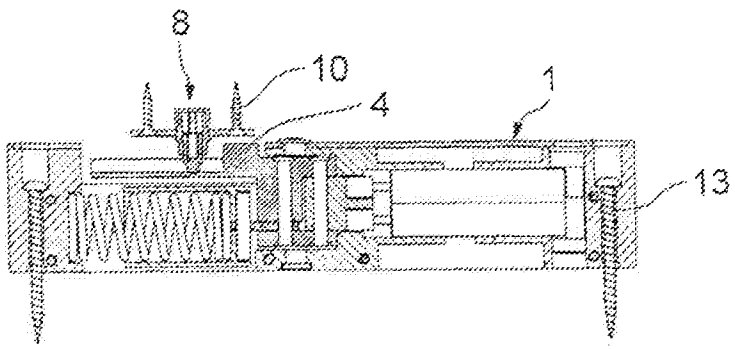

FIG. 15 illustrates a catch that cooperates with the door opening and closing device 1. In FIG. 15, the catch 8 mounted on the upper-side frame f that surrounds the door d is seen from the bottom. The catch 8 has a catch base 11 that is fixed to the lower surface of the frame f by a countersunk screw 10 and a catch shaft 12 that projects from the catch base 11. As illustrated in FIG. 16(*a*), when the door d gets closed to a certain angle, the retractable arm 4 in the open state catches the catch shaft 12 of the catch 8. The retractable arm 4 tries rotating in the closing direction while it catches the catch shaft. Then, as illustrated in FIG. 16(*b*), the retractable arm 4 makes the door d in the completely closed state.

When a person goes out of a room and closes the door d lightly, sometimes the door d is not closed completely. Even when the door d is closed lightly, the door d can be closed completely by making the retractable arm 4 of the door opening and closing device 1 catch the catch shaft 12. And, when the open door d gets closed forcefully by wind or the like, the door opening and closing device 1 attenuates the impact on the door and makes the door d get closed slowly. The door opening and closing device 1 acts to retract the door d and also to slow movement of the door d.

FIGS. 17(*a*) to 17(*d*) illustrate the door opening and closing device 1 and the catch 8 mounted on the door d and the frame f. FIG. 17(*a*) is a side view and FIG. 17(*b*) is a front view. FIGS. 17(*c*) and 17(*d*) are cross sectional views corresponding to FIGS. 17(*a*) and 17(*b*). The catch 8 is fixed to the frame f by the countersunk screw 10. The door opening and closing device 1 is fixed to the door d by a retaining screw 13. As illustrated in these figures, when the door d is in the closed state, the retractable arm 4 of the door opening and closing device 1 is also in the closed state. However, strictly speaking, when the door d is in the closed state, the retractable arm 4 of the door opening and closing device 1 is rotated slightly in the opening direction from the closed state. This is for the purpose of preventing rattling of the door d by applying an additional force in the closing direction to the door d in the closed state by the retractable arm 4 of the door opening and closing device 1.

FIG. 18 is an exploded perspective view of the door opening and closing device. The door opening and closing device 1 has the body case 2, an arm base 21 which is built in the body case 2, the retractable arm 4 supported rotatable by the arm base 21, a biasing mechanism 22 for giving a torque in the closing or opening direction to the retractable arm 4 and a damper mechanism 23 for attenuating impact when the retractable arm 4 gets closed. The arm base 21 is arranged at the center of the body case 2 in the longitudinal direction. The biasing mechanism 22 is arranged at one side of the body case 2 in the longitudinal direction and the damper mechanism 23 is arranged at the opposite side to the biasing mechanism 22 in such a way that the arm axis 5 is sandwiched between the biasing mechanism 22 and the damper mechanism 23.

The outline structure of each part is described below. The body case 2 has the ceiling part 2*a*, and a pair of side wall parts 2*b*. The cross section of the body case 2 is U shaped. The body case 2 has a lower surface and end surfaces in the longitudinal direction, where openings 24*a*, 24*b* are formed for installation of the parts. Besides, in the ceiling part 2*a* of the body case 2, the notch 3 is formed for exposing the retractable arm 4. This body case 2 is manufactured by sheet metal processing of bending a thin plate.

The arm base 21 is arranged at the center of the body case 2 in the longitudinal direction and is a central part from structural and assembly points of view. The arm base 21 takes an approximately U shape and has first and second wall pars 21*a*, 21*b* facing each other and a linking part 21*e* for linking the first and second wall parts 21*a*, 21*b* to each other. The retractable arm 4 is inserted into between the first and second wall parts 21*a*, 21*b* and the arm axis 5 is made to pass through the arm base 21 and the retractable arm 4 from below, thereby connecting the retractable arm 4 to the arm base 21 rotatably. After the retractable arm 4 is connected to the arm base 21, the arm base 21 is inserted into and connected to the body case 2. Connection of the arm base 21 and body case 2 is made with use of a rivet, screw or the like. In the arm base 21 and the body case 2, mounting holes 21*c* and 2*c* are formed for connecting the arm base 21 to the body case 2.

The retractable arm 4 rotates around the arm axis 5. The first and second link shafts 26, 27 are inserted into the retractable arm 4 at off-center positions from the arm axis 5. As illustrated in FIG. 19, the first link shaft 26 is always given a force of the compression spring 28 of the biasing mechanism 22. With this spring force of the compression spring 28, a force to retract the door d acts on the retractable arm 4. The slide block 31 of the damper mechanism 23 is connected to the second link shaft 27. When the retractable arm 4 is rotated in the closing direction, the slide block 31 pushes the heads of the rods 32*a* of the dampers 32. Therefore, if the retractable arm 4 tries to rotate in the closing direction quickly, the dampers 32 make the retractable arm 4 rotate slowly.

As illustrated in FIG. 18, the biasing mechanism 22 has the above-mentioned first link shaft 26, the first link 33, the slide spring case 34 as the first slider, the compression spring 28 and the spring base 35.

In the retractable arm 4, a slit 4*a* is formed. While the first link 33 is fit in the slit 4*a* in such a way as to sandwich the first link 33, the first link shaft 26 is made to pass through the retractable arm 4 and the first link 33 from above thereby to connect the first link to the retractable arm 4. At the other end of the first link 33, the spring linking shaft 36 is fit therein. This spring linking shaft 36 is used to connect the slide spring case 34 to the first link 33.

The slide spring case 34 is mounted in the body case 2 to be linearly movable. In a side surface of the slide spring case 34, a protrusion 34*a* is formed elongated linearly. In the body case 2, a slit 2*d* is formed for fitting the protrusion 34*a* therein. Linear movement of the slide spring case 34 relative to the body case 2 is guided by the slit 2*d* of the body case 2.

In the slide spring case 34, a hole is formed of which the diameter is slightly larger than the diameter of the compression spring 28. The compression spring 28 is inserted in this hole. At the opposite side of the compression spring 28 to the slide spring case 34, the spring base 35 is arranged. The spring base 35 has a hole of which diameter is slightly larger than the diameter of the compression spring 28. The compression spring 28 is compressed between the slide spring case 34 and the spring base 35. The spring base 35 is fixed to the end of the body case 2 by a rivet, screw or the like. In the spring base 35 and the body case 2, mounting holes 35*a*, 2*e* are formed for connecting the spring base 35 to the body case 2.

The damper mechanism 23 has the second link shaft 27, the slide block 31 as second slider, dampers 23, a damper base 38 and a damper adjusting shaft 40.

In the retractable arm 4, a notch 4*b* is formed for insertion of the slide block 31. The slide block 31 is inserted into the notch 4*b* of the retractable arm 4 and the second link shaft 27 is made to pass through the retractable arm 4 and the slide block 31 from above, thereby connecting the slide block 31 to the retractable arm 4. In the slide block 31, a long hole 31*a* is formed in which the second link shaft 27 passes through. This is for the purpose of moving the slide block 31 linearly when the retractable arm 4 is rotated. As illustrated in FIG. 19, the head of the rod 32*a* of the damper 32 is inserted into the slide block 31. Linear movement of the slide block 31 is guided by the inner wall surface 2*f* of the body case 2 and the wall surface 21*d* of the arm base 21.

As illustrated in FIG. 18, the damper 32 used here is an extendable damper 32 having the rod 32*a* that moves relative to a main body part 32*b*. When the rod 32*a* contracts relative to the main body part 32*b*, a damping force is generated against the movement of the rod 32*a*. In this example, two, upper and lower, dampers 32 are used in combination.

At the end of the body case 2, the damper base 38 is connected thereto by a rivet, screw or the like. The damper base 38 and the body case 2 have mounting holes 38*a*, 2*g* for connecting the damper base 38 to the body case 2. The damper base 38 functions as a holding member for the dampers 32. In the damper base 38, the damper adjusting shaft 40 is mounted for adjusting the strength of the dampers 32. The damper adjusting shaft 40 abuts to the back parts of the dampers 32. The positions of the back parts of the two, upper and lower, dampers 32 can be adjusted by rotating the damper adjusting shaft 40. Out of three holes of the damper base 38, one 41*a* is a hole for mounting the door opening and closing device 1 to the door d. The other two, right and left, holes 41*b* are provided for insertion of the damper adjusting shaft 40. They are used to support the door d opening to both right and left sides. The direction in which the retractable arm 4 gets out of the body case 2 varies depending on the opening direction of the door d. In order to support both opening directions of the door d with one component only, the two holes 41*b* are formed. Further, in the damper base 38, recesses 38*b* are formed for storing the upper and lower dampers 32. These recesses 38*b* are provided two, corresponding to the two opening directions of the door d. Here, the position of the notch 3 of the body case 2 needs to change depending on the opening direction of the door d, however, this is satisfied by changing the bending direction of the thin plate and only one die of the thin plate is enough.

Figure 20A:
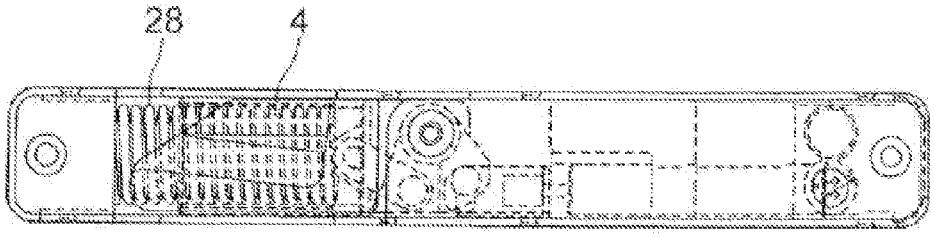
FIGS. 20(*a*) to 20(*c*) are operation diagrams of the door opening and closing device (FIG. 20(*a*) illustrates the retractable arm in the closed state, FIG. 20(*b*) illustrates the retractable arm in the half-open state and FIG. 20(*c*) illustrates the retractable arm in the open state)
Figure 20B:
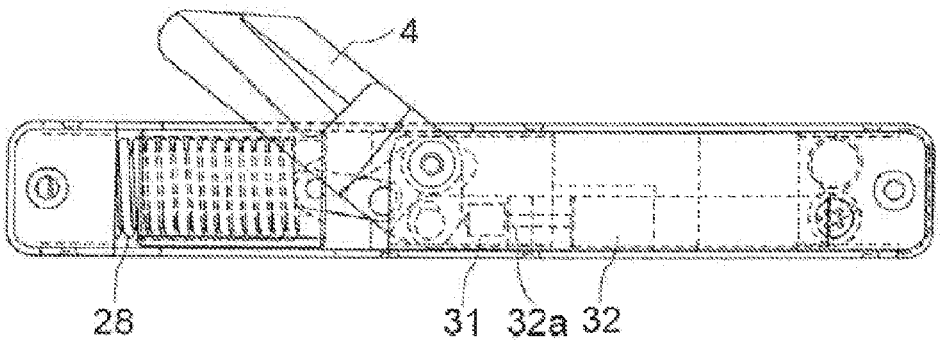
Figure 20C:
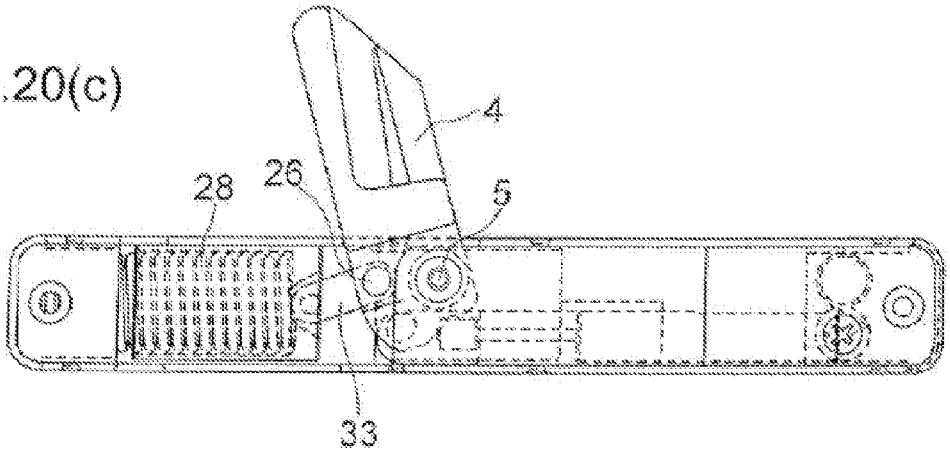

The door opening and closing device 1 operates as follows. The retractable arm 4 is rotated from the closed state as illustrated in FIG. 20(*a*) to the open state as illustrated in FIG. 20(*c*). When the retractable arm 4 is in the closed state, the retractable arm 4 is given an additional force to rotate in the closing direction by the spring force of the compression spring 28 of the biasing mechanism 22. When the retractable arm 4 is rotated in the opening direction against the spring force of the compression spring 28, it reaches the change point of the biasing mechanism 22. Then, the retractable arm 4 is further rotated in the opening direction and passed by the change point of the biasing mechanism 22. As illustrated in FIG. 20(*c*), a force to rotate the retractable arm 4 in the opening direction is generated by the spring force of the compression spring 28. Here, at the change point, the line connecting the arm axis 5 to the first link shaft 26 coincides with the direction where the first link 33 extends, and no force to rotate the retractable arm 4 is generated.

When the door d in the open state as illustrated in FIG. 20(*c*) is to be closed, the retractable arm is rotated in the counterclockwise direction. As illustrated in FIG. 20(*b*), when passing the change point, the retractable arm 4 is given a force to rotate in the closing direction by the spring force of the compression spring 28. Accordingly, it becomes possible to close the door d automatically. Besides, as the retractable arm 4 rotates in the closing direction, the slide block 31 pushes the heads of the rods 32*a* of the dampers 32. Therefore, rotation of the retractable arm 4 can be made slow.

When the retractable arm 4 is rotated in the closing direction, the slide block 31 is made to abut to the heads of the rods 32*a* of the dampers 32 so that the dampers 32 can resist linear movement of the slide block 31. Meanwhile, when the retractable arm 4 is rotated in the opening direction, the slide block 31 goes away from the heads of the rods 32*a* of the dampers 32 so as not to resist the linear movement of the slide block 31. This is because no resistance is preferable for opening the door d. As illustrated in FIG. 19, the slide block 31 is not linked to the heads of the rods 32*a* of the dampers 32. The heads of the rods 32*a* are merely placed in the slide block 31. The arm base 21 and the body case 2 guide the slide block 31 and the dampers 32 so as to prevent play of the dampers 32 and the slide block 31 when the slide block 31 is away from the dampers 32.

The door opening and closing device 1 is assembled in the following manner. First, as illustrated in FIG. 18, the first link 33 is inserted into the slit 4*a* of the retractable arm 4, the first link shaft 26 is inserted into the retractable arm 4 from above and the first link 33 is linked to the retractable arm 4. Then, the slide block 31 is inserted into the notch 4*b* of the retractable arm 4, and the second link shaft 27 is inserted into the retractable arm 4 from above so that the slide block 31 is connected to the retractable arm 4. While the first link 33 and the slide block 31 are connected to the retractable arm 4, the retractable arm 4 is sandwiched between the first and second wall parts 21*a*, 21*b* of the arm base 21 facing each other. Then, the arm axis 5 is inserted from below thereby to connect the retractable arm 4 to the arm base 21.

Then, while the retractable arm 4 and the arm base 21 are assembled, the arm base 21 is inserted into the body case 2. The arm axis 5 is inserted into the ceiling part 2*a* of the body case 2, the end of the arm axis 5 is fixed with a flat washer 43, and rivets are inserted into the mounting holes 2*c* and 21*c* of the body case 2 and the arm base 21 to rivet the arm base 21 to the body case 2.

Next, the spring linking shaft 36 is fit in the first link 33, the slide spring case 34 is fit to the slit 2*d* of the body case 2 and the slide spring case 34 is connected to the spring linking shaft 36. When the compression spring 28 is inserted in the slide spring case 34, the spring base 35 is inserted via the opening 24*a* at the end of the body case 2, rivets are inserted into the mounting holes 2*e* and 35*a* of the body case 2 and the spring base 35 and the spring base 35 is riveted to the body case 2.

Next, the two dampers 32 are inserted into the arm base 21 via the opening 24*c* at the opposite end of the body case 2. The damper base 38 is fit into the body case 2, rivets are inserted into mounting holes 2*g* and 38*a* of the body case 2 and the damper base 38 and the damper base 38 is riveted to the body case 2.

Through these steps, assembly of all the parts is completed. As the retractable arm 4, the first link 33 and the slide block 31 are assembled into the arm base 21 in advance and then, the arm base 21 is installed in the body case 2, the assembly work can be facilitated. It is only three parts, that is, the arm base 21, the spring case 35 and the damper base 38, that are connected to the body case 2.

Figure 21A:
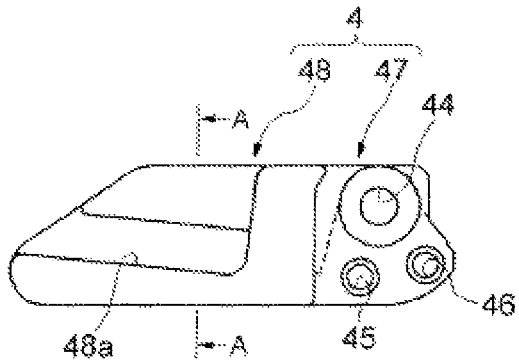
FIGS. 21(*a*) to 21(*c*) are detail views of the retractable arm (FIG. 21(*a*) is a plan view, FIG. 21(*b*) is a front view and FIG. 21(*c*) is a cross sectional view taken along the line A-A)
Figure 21B:
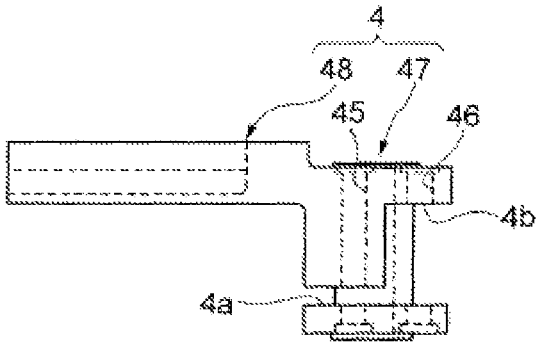
Figure 21C:
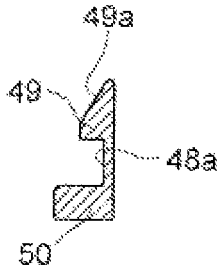
Figure 22A:
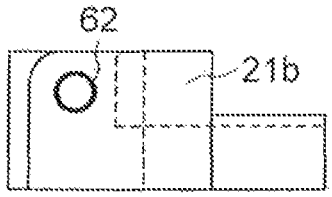
FIGS. 22(*a*) to 22(*d*) are detail views of the arm base (FIG. 22(*a*) is a plan view, FIG. 22(*b*) is a front view, FIG. 22(*c*) is a left side view and FIG. 22(*d*) is a right side view)
Figure 22B:
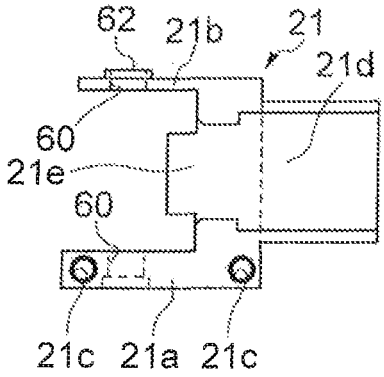
Figure 22C:
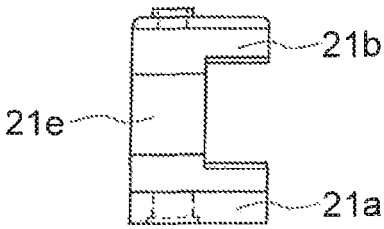
Figure 22D:
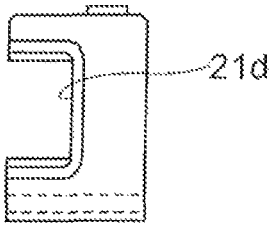
Figure 23A:
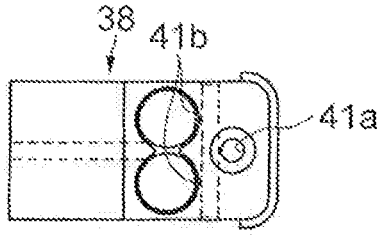
FIGS. 23(*a*) to 23(*d*) are detail views of the damper base (FIG. 23(*a*) is a plan view, FIG. 23(*b*) is a front view, FIG. 23(*c*) is a cross sectional view taken along the line A-A and FIG. 23(*d*) is a left side view)
Figure 23B:
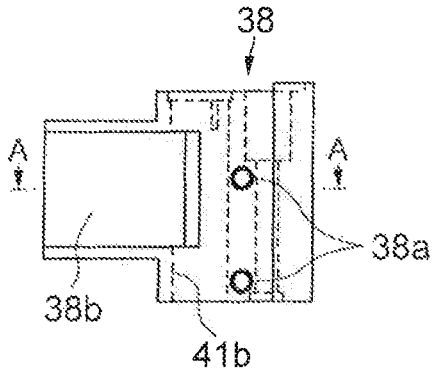
Figure 23C:
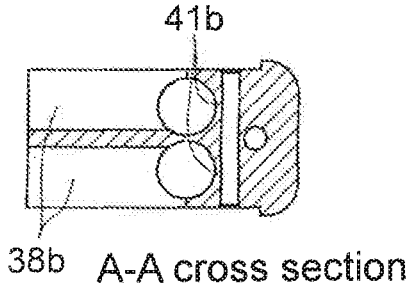
Figure 23D:
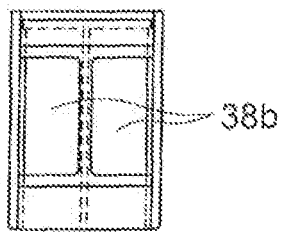
Figure 24A:
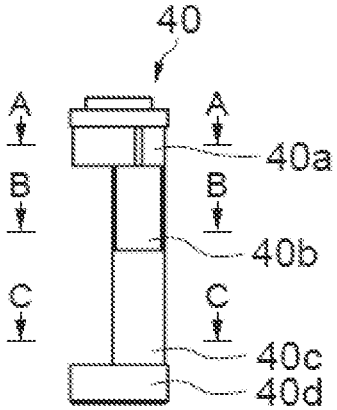
FIGS. 24(*a*) to 24(*e*) are detail views of a damper adjusting shaft (FIG. 24(*a*) is a front view, FIG. 24(*b*) is a plan view, FIG. 24(*c*) is a cross sectional view taken along the line A-A, FIG. 24(*d*) is a cross sectional view taken along the line B-B, and FIG. 24(*e*) is a cross sectional view taken along the line C-C)
Figure 24D:
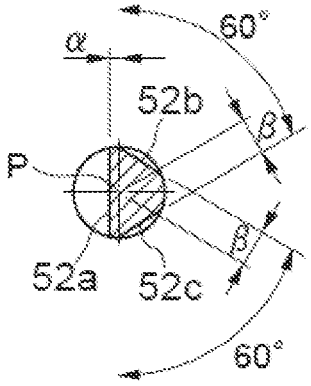
Figure 24B:
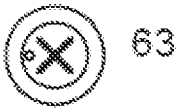
Figure 24E:
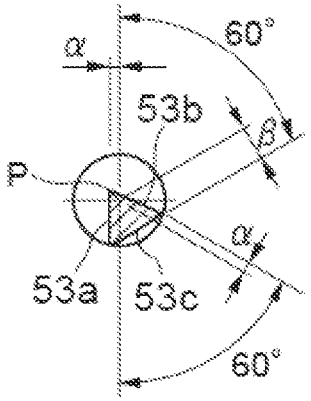
Figure 24C:
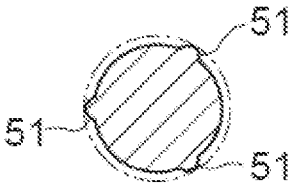

The detail structures of the retractable arm 4, the arm base 21, the damper base 38 and the damper adjusting shaft 40 are described below. FIGS. 21(*a*) to 21(*c*) are detail views of the retractable arm 4. The retractable arm 4 has a main body part 47 and an arm part 48. In the main body part 47, an arm axis hole 44 and two link shaft holes 45, 46 are formed. The arm part 48 extends horizontally from the upper end of the main body part 47. In the upper surface of the arm part 48, a groove part 48*a* is formed for inserting the catch shaft of the catch 8. The groove part 48*a* extends from a midpoint of the arm part 48 to the tip end. As illustrated in the cross sectional view of FIG. 21(*c*), both-side wall parts 49, 50 of the groove part 48*a* are different in height from each other (lengths in horizontal direction in the figure). When the retractable arm 4 is in the open state, the catch shaft 12 is inserted into the tip end of the groove part 48*a*. Then, the catch shaft 12 abuts to the higher wall part 50 to rotate the retractable arm 4. With rotation of the retractable arm 4, the catch shaft 12 moves toward the back of the groove part 48*a*. The catch shaft 12 can enter the groove part 48*a* at a midpoint of the groove part 48*a* of the arm part 48. When the retractable arm 4 is in the closed state, the catch shaft 12 climbs over the lower wall part 49 of the arm part 48 and enters the groove part 48*a*. The lower wall part 49 has an inclined surface 49*a* for the catch shaft 12 to enter the groove part easily.

The main body part 47 of the retractable arm 4 has the arm axis hole 44 for insertion of the arm axis 5 and two link shaft holes 45, 46 at off-center positions from the arm axis hole. The first and second link shafts 26, 27 pass through the two link shaft holes 45, 46. In the main body part 47 of the retractable arm 4, the slit 4*a* is further formed for insertion of the first link 33. This slit 4*a* is linked to the link shaft hole 45. In addition, in the main body part 47 of the retractable arm 4, the notch 4*b* is formed for insertion of the slide block 31. This notch 4*b* is coupled to the link shaft hole 46. The retractable arm 4 is manufactured by injection molding of resin.

FIGS. 22(*a*) to 22(*d*) are detail views of the arm base 21. The arm base 21 is of approximately U shape as a whole. The arm base 21 has a first wall part 21*a* for supporting the lower end of the arm axis 5, a second wall part 21*b* facing the first wall part 21*a* and provided for supporting the upper end of the arm axis 5 and a linking part 21*e* for linking the first and second wall parts 21*a*, 21*b*. The first wall part 21*a* and the second wall part 21*b* have holes 60 for inserting the arm axis 5. The retractable arm 4 is sandwiched between the first wall part 21*a* and the second wall part 21*b* of the arm base 21 and the arm axis 5 is made to pass through the arm base 21 and the retractable arm 4 from below. Then, the retractable arm 4 is connected to the arm base 21. As rotational movement of the retractable arm 4 is guided by the first and second wall parts 21*a*, 21*b* of the arm base 21, the retractable arm 4 can rotate in a stable manner. In a side surface of the first wall part 21*a* of the arm base 21, a mounting hole 21*c* is formed for connecting the arm base 21 to the body case 2. In the arm base 21, a wall surface 21*d* is formed for guiding the slide block 31 and the dampers 32.

In the upper surface of the second wall part 21*b*, a ring-shaped protrusion 62 is formed. When the body case 2 is inserted into the arm base 21, this ring-shaped protrusion 62 is fit in the hole of the ceiling part 2*a* of the body case 2. The upper surface of the second wall part 21*b* of the arm base 21 is in contact with the lower surface of the ceiling part 2*a* of the body case 2. The lower end of the arm axis 5 is supported by the thick first wall part 21*a* and the upper end of the arm axis 5 is supported by the ceiling part 2*a* of the body case 2 and the second wall part 21*b*. As the arm axis 5 is supported at both ends, the support strength of the arm axis 5 can be increased. As the upper end of the arm axis 5 is supported by the ceiling part 2*a* of the body case 2 and the second wall part 21*b* of the arm base 21, the thickness of the second wall part 21*b* of the arm base 21 can be reduced, the height of the door opening and closing device 1 can be reduced, and the hole in the door upper surface can be made shallow. Besides, as the first and second wall parts 21*a*, 21*b* are provided in the arm base 21, it becomes easy to assemble the retractable arm 4 into the arm base 21. The arm base 21 is manufactured by injection molding of resin.

Here, the arm base 21 has only to support at least one end of the arm axis 5. For example, the second wall part 21*b* of the arm base 21 may be omitted and the arm axis 5 may be supported between the first wall part 21*a* of the arm base 21 and the ceiling part 2*a* of the body case 2. Besides, the arm axis 5 may be supported only between the first wall part 21*a* and the second wall part 21*b* of the arm base 21 and not by the ceiling part 2*a* of the body case 2.

FIGS. 23(*a*) to 23(*d*) are detail views of the damper base 38. The damper base 38 has formed therein recesses 38*b* for storing two, upper and lower, dampers 32 and holes 41*b* for inserting the damper adjusting shaft 40 configured to adjust the strength of the dampers 32. In order to support the door d opening to the left and right, two recesses 38*b* and two holes 41*b* are provided. In the damper base 38, a hole 41*a* is also formed for mounting the door opening and closing device 1 on the door upper surface.

FIGS. 24(*a*) to 24(*e*) illustrate the damper adjusting shaft 40 which is inserted into a hole 41*b* of the damper base 38. As illustrated in FIG. 24(*c*), the cross sectional shape of the upper step 40*a* of the damper adjusting shaft 40 is round, and on its outer peripheral surface, three protrusions 51 are formed 120-degree separated from each other. In the inner peripheral surface of the hole 41*b* of the damper base 38, three recesses are formed 120-degree separated from each other, and the protrusions 51 are fit in these recesses. In the upper surface of the damper adjusting shaft 40, a cross-shaped groove part 63 is formed. The damper adjusting shaft 40 can be rotated by placing a driver on the cross-shaped groove part 63 of the damper adjusting shaft 40 and rotating the driver. With engagement between the protrusions 51 and the recesses, the damper adjusting shaft 40 is positioned by each 120-degree rotation.

Figure 25A:
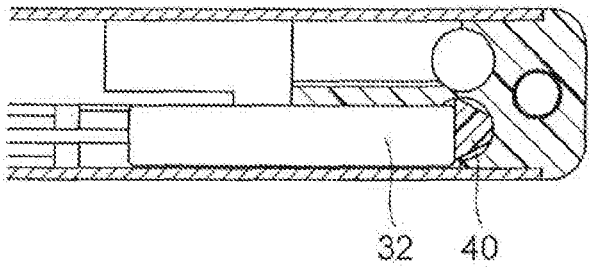
FIGS. 25(*a*) and 25(*b*) are views illustrating a damper position-adjusted by the damper adjusting shaft (FIG. 25(*a*) illustrates the damper moved backward, and FIG. 25(*b*) illustrates the damper pushed forward)
Figure 25B:
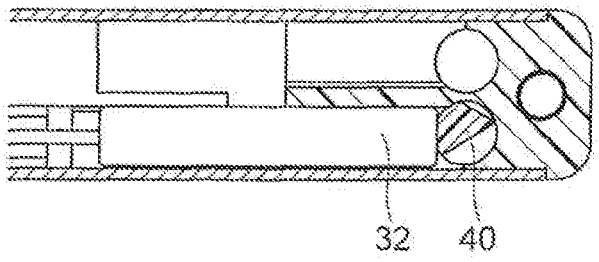

As illustrated in FIG. 24(*d*), the cross sectional shape of the middle step 40*b* of the damper adjusting shaft 40 is a triangle. On side 52*a* of the middle-step triangle is near the rotational center and its distance is α. The other two sides 52*b*, 52*c* are away from the rotational center and their distance is β. The height of the middle step of the damper adjusting shaft 40 is equal to the height of the upper damper 32 out of the two dampers 32, and one side of 52*a* to 52*c* of the triangle of the middle step 40*b* of the damper adjusting shaft 40 is in contact with the back part of the upper damper 32. The one side that is in contact with the back part of the damper 32 switches between 52*a* to 52*c* by rotating the damper adjusting shaft 40. When the side 52*a* is in contact with the damper 32, the damper 32 can be moved backward, while, when the side 52*b* or 52*c* is in contact with the damper 32, the damper can be pushed forward. FIG. 25(*a*) illustrates the damper 32 moved backward by the damper adjusting shaft 40 and FIG. 25(*b*) illustrates the damper 32 pushed forward by the damper adjusting shaft 40.

As illustrated in FIG. 24, the cross sectional shape of the lower step 40*c* of the damper adjusting shaft 40 is also a triangle. As illustrated in FIG. 24(*e*), two sides 53*a* and 53*b* of the lower-step triangle are near the rotational center and their distance is α. The other side 53*c* is away from the rotational center and its distance is β. The height of the lower step 40*c* of the damper adjusting shaft 40 is equal to the height of the lower damper 32 out of the two dampers 32. One side of the triangle of the lower step 40*c* of the damper adjusting shaft 40 is in contact with the back part of the lower damper 32. By rotating the damper adjusting shaft 40, the sides in contact with the end of the damper can vary. When the sides 53*a* and 53*b* are in contact with the damper 32, the damper 32 can be moved backward, while when the side 53*c* is in contact with the damper 32, the damper 32 can be pushed forward.

Figure 26A:
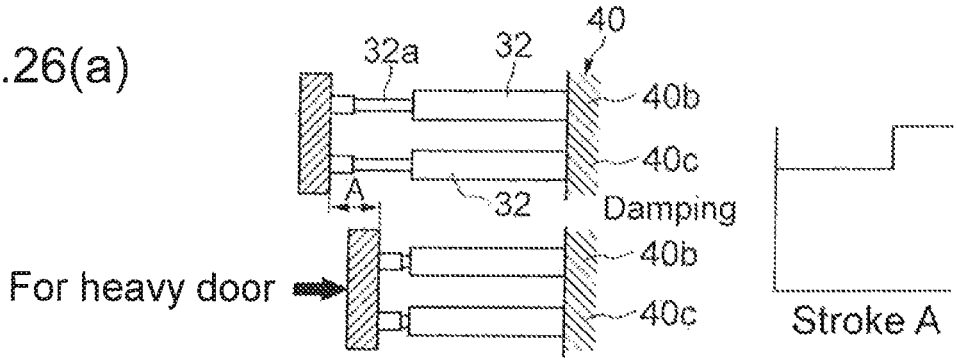
FIGS. 26(*a*) to 26(*c*) are schematic diagrams illustrating the relationship between positions of the damper and damping forces (FIG. 26(*a*) illustrates the case of a heavy door, FIG. 26(*b*) illustrates the case of a middle-weight door, and FIG. 26(*c*) illustrates the case of a light-weight door)
Figure 26B:
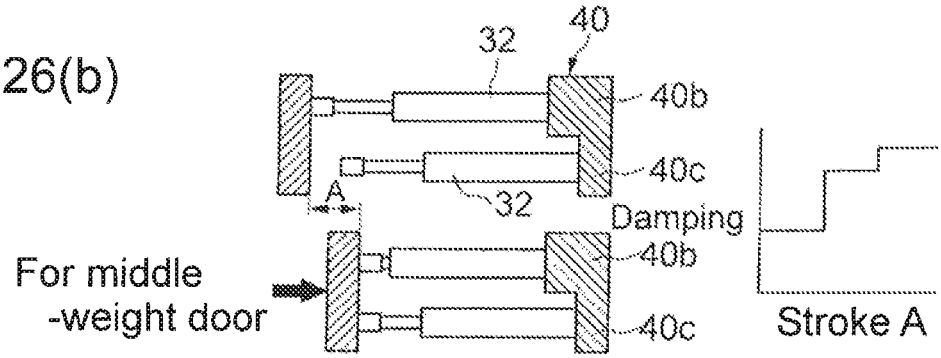
Figure 26C:
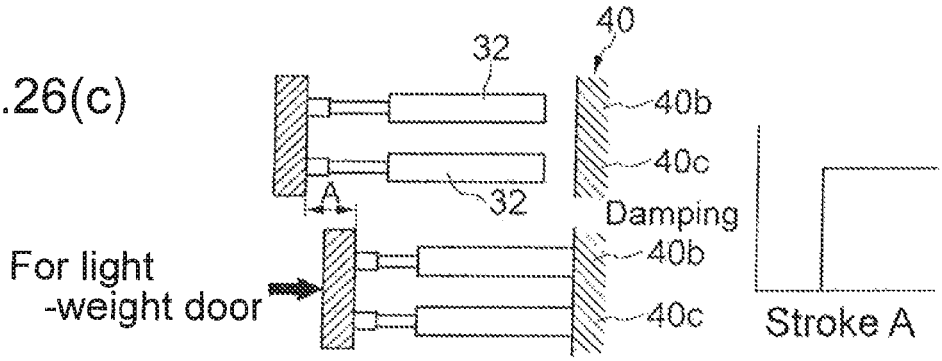

With use of this damper adjusting shaft 40, it is possible to adjust the positions of the two dampers 32 at three levels by rotating the damper adjusting shaft 40 by 120 degrees. That is, it is possible to switch between the state where two dampers 32 are pushed forward as illustrated in FIG. 26(*a*), the state where the upper damper 32 is pushed forward and the lower damper 32 is not pushed as illustrated in FIG. 26(*b*) and the state where the two dampers 32 are not pushed as illustrated in FIG. 26(*c*), sequentially. The damping force is also switched between three levels of large, middle and small. As illustrated in FIG. 26(*a*), when the two dampers 32 are pushed forward, the damping force becomes large enough to support a heavy door. In the state illustrated in FIG. 26(*b*), the damping force is middle enough to support a middle-weight door. In the state illustrated in FIG. 26(*c*), the damping force is small enough to support a light-weight door. As illustrated in FIG. 26(*c*), there may be a gap between the side of the damper adjusting shaft 40 and the dampers 32. If the gap is created, it is possible to prevent the damping force from being exerted on the first stroke of the slide block 31.

In this embodiment, the damper 32 used here is a damper that exerts a large damping force at a final stroke of 5 mm, for example. Therefore, the damping force for the stroke of the slide block 31 is as illustrated in the graph in the right column of FIG. 26.

Figure 27A:
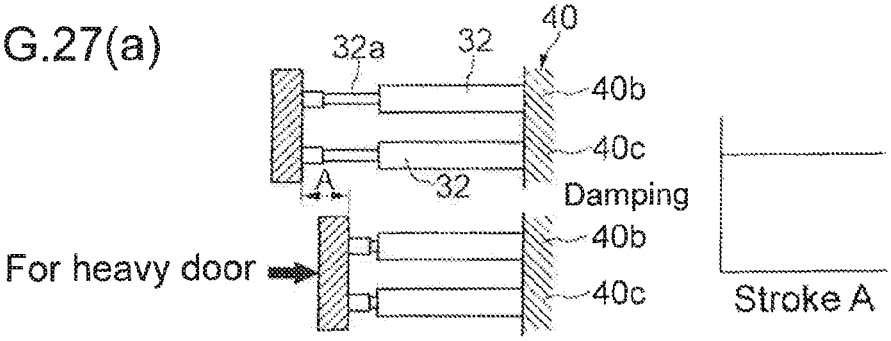
FIGS. 27(*a*) to 27(*c*) are schematic diagrams illustrating the relationship between positions of the damper and damping forces (FIG. 27(*a*) illustrates the case of a heavy door, FIG. 27(*b*) illustrates the case of a middle-weight door, and FIG. 27(*c*) illustrates the case of a light-weight door)
Figure 27B:
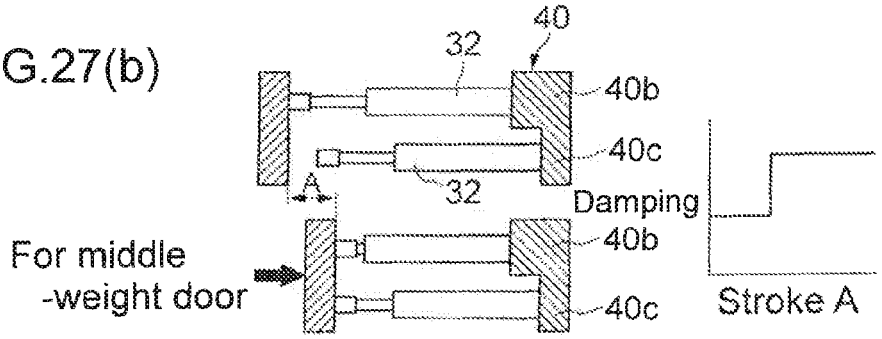
Figure 27C:
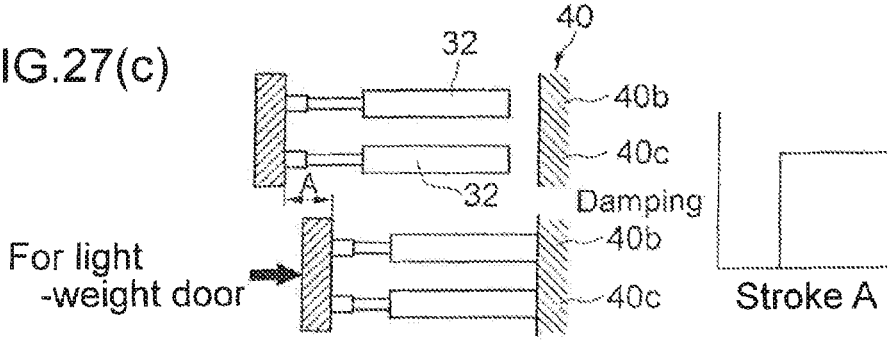

Irrespective of the stroke of the rod, the damper 32 may be a damper with a fixed damping force. The damping force of the damper 32 that does not vary in strength is illustrated in FIG. 27.

Figure 28:
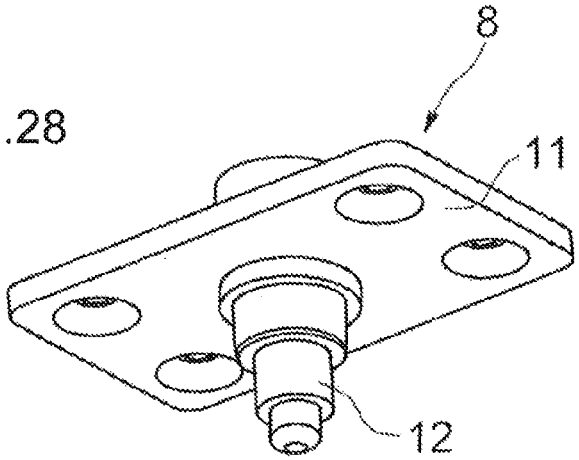
FIG. 28 is a perspective view of the catch.
Figure 29:
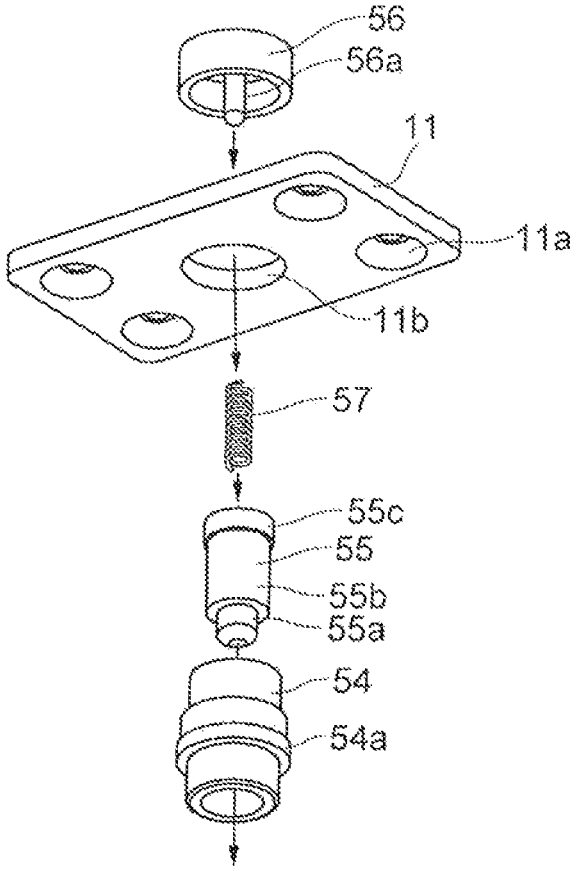
FIG. 29 is an exploded perspective view of the catch.

FIGS. 28 and 29 are detail views of the catch 8. FIG. 28 is a perspective view of the catch 8 and FIG. 29 is an exploded perspective view of the catch 8. The catch 8 has the catch base 11 mounted on the frame f and the catch shaft 12 projecting from the catch base 11. The retractable arm 4 of the door opening and closing device 1 catches the catch shaft 12 of the catch 8 to open and close the door d.

As illustrated in FIG. 29, the catch base 11 is formed into a rectangle. At four corners of the catch base 11, four countersunk screw-mounting holes 11*a* are formed. At a center hole 11*b* of the catch base 11, the catch shaft 12 is fit therein.

The catch shaft 12 has a hollow-cylindrical catch outer shaft 54, a cylindrical catch inner shaft 55 enclosed at one end, and a back cover 56. On the outer peripheral surface of the catch outer shaft 54, a flange 54*a* is formed, and the catch outer shaft 54 is pushed into the hole 11*b* of the catch base 11 until the flange 54*a* abuts to the catch base 11. The back cover 56 is connected to the catch outer shaft 54 from the back surface side of the catch base 11. In the back cover 56, a support bar 56*a* is formed, which is fit in the center of a catch spring 57 to support the catch spring 57.

In the catch outer shaft 54, the catch inner shaft 55 is fit. The catch inner shaft 55 is of an approximately cylindrical shape and is enclosed at a tip end. At the tip end of the catch inner shaft 55, a cylindrical small-diameter part 55*a* is formed. That is, in the catch inner shaft 55, the small-diameter part 55*a* and a large-diameter part 55*b* which is concentric with the small-diameter part are formed. With these small-diameter part 55*a* and large-diameter part 55*b*, step difference is provided at the tip end of the catch inner shaft 55. The catch spring 57 is inserted into the large-diameter part 55*b* of the catch inner shaft 55. The catch spring 57 is placed between the catch inner shaft 55 and the back cover 56 to make the catch inner shaft 55 jut from the catch outer shaft 54. The catch inner shaft 55 is made to jut from the catch outer shaft 54 until the flange 55*c* of the catch inner shaft 55 abuts to the step difference in the inner peripheral surface of the catch outer shaft 54. Needless to say, the catch inner shaft 55 may be pushed into the catch outer shaft 54 against the spring force of the catch spring 57.

Figure 30A:
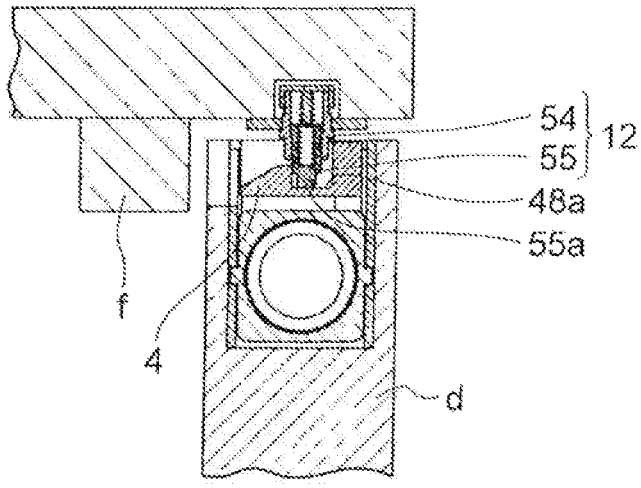
FIGS. 30(*a*) and 30(*b*) are views illustrating the relationship between the catch and the retractable arm (FIG. 30(*a*) illustrates the catch shaft fit in the groove part of the retractable arm and FIG. 30(*b*) illustrates a small-diameter part of the catch shaft fit in the groove part of the retractable arm).
Figure 30B:
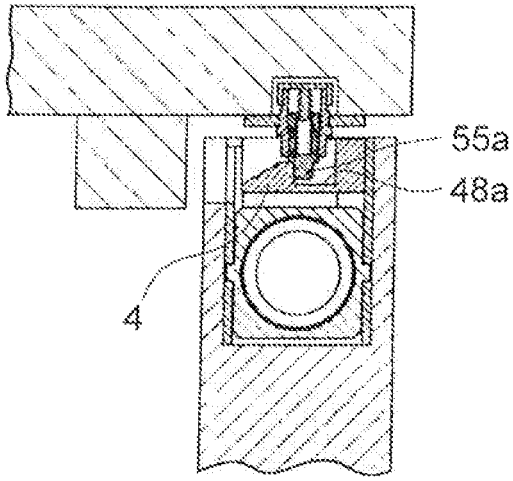

As illustrated in FIG. 30(*a*), when the door d is closed, in order to prevent rattling of the door d, the retractable arm 4 of the door opening and closing device 1 catches the catch shaft 12 to give an additional force in the closing direction, even if the door d comes into contact with the frame f. That is, when the door d is closed, the retractable arm 4, itself, is not rotated to the completely closed state and the rotation angle of the retractable arm 4 is just before the closed-state rotation angle. There still remains room for the retractable arm 4 to rotate in the closing direction.

If the retractable arm 4 in the open state is brought into the closed state unnecessarily, in error, the retractable arm 4 is rotated to the closed state. In this case, if the door d is tried to be closed into the return state where the catch shaft 12 is fit in the groove part 48*a* of the retractable arm 4, the catch shaft 12 cannot be fit in the groove part 48*a* of the retractable arm 4. As illustrated in FIG. 30(*b*), as the small-diameter part 55*a* is formed at the tip end of the catch shaft 12, if the retractable arm 4 is rotated to the closed state, the small-diameter part 55*a* can be caught in the groove part 48*a* of the retractable arm 4 by a difference of diameter between the large-diameter part 55*b* and the small-diameter part 55*a*. When the small-diameter part 55*a* of the catch shaft 12 can be caught in the groove part 48*a* of the retractable arm 4, the retractable arm 4 can be rotated to the open state, and in next use, the catch shaft 12 will be able to be caught in the groove part 48*a* of the retractable arm 4 so that the door opening and closing device 1 can be used in a normal way.

Here, the present invention is not limited to the above-described embodiments and may be embodied in various forms without departing from the scope of the present invention.

The door opening and closing device according to the present embodiment can be used to assist opening and closing of not only a hinged door but also a sliding door.

The body case of the door opening and closing device may have an opening in any one of surfaces thereof, and for example, the opening may be formed not in the bottom surface but in a side surface. If the door opening and closing device is mounted on the side surface, not on the upper surface of the door, the opening may be formed in the side surface of the body case.

When the end of the body case of the door opening and closing device in the longitudinal direction is bent into a wall, the damper base and spring base may be omitted.

The damper of the door opening and closing device may be an extendable damper, a rotary damper or the like.

The present specification is based on Japanese Patent Applications No. 2009-191099 filed on Aug. 20, 2009, the entire contents of which are expressly incorporated by reference herein.

Reference Numerals

1, 101 . . . door opening and closing device
2, 102 . . . body case
4, 104 . . . retractable arm
5, 105 . . . arm axis
21 . . . arm base
21*a*, 21*b* . . . *first and second wall parts*
21*e* . . . *linking part*
28, 128 . . . compression spring (biasing member)
31, 131 . . . slide block (second slider)
32, 132 . . . damper
33, 133 . . . first link
34, 134 . . . slide spring case (first slider)
115 . . . second link
116 . . . adjusting plate (position adjusting means)
117 . . . adjusting nut (position adjusting means)
121 . . . arm block (retractable arm)
135 . . . spring catch
140 . . . adjusting screw (position adjusting means)

The invention claimed is:

1. A door opening and closing device comprising:

a body case elongated in one direction;

a retractable arm which is provided rotatable in the body case, rotates from an open state to a closed state, and has an arm axis as a rotational center thereof;

a first slider which is provided at one side of the arm axis in the one direction in the body case and moves linearly in the one direction in conjunction with rotation of the retractable arm;

a first link which is rotatable and directly connected to the retractable arm at an off-center position from the arm axis and is rotatable and directly connected to the first slider;

a second slider which is provided at an opposite side of the arm axis in the one direction in the body case in such a way that the arm axis is located between the first slider and the second slider and which moves linearly in the one direction in conjunction with rotation of the retractable arm;

a biasing member which is provided at the one side of the body case and biases the first slider in the one direction; and a damper which is provided at the opposite side of the body case and resists linear movement of the second slider, wherein the biasing member gives the retractable arm in the open state a biasing force in an opening direction, and when the retractable arm in the open state is rotated in a closing direction by a predetermined angle or more, the biasing member gives the retractable arm a biasing force in the closing direction, and when the retractable arm is rotated in the closing direction, the damper damps rotation of the retractable arm.

2. The door opening and closing device of claim 1, further comprising a second link which is connected to the retractable arm at an off-center position from the arm axis and is connected rotatable to the second slider.

3. The door opening and closing device of claim 1, wherein the biasing member is a compression spring.

4. The door opening and closing device of claim 3, further comprising:

a spring catch which is provided at the one side of the arm axis in the body case for catching the compression spring; and position adjusting means for adjusting a position of the spring catch in the one direction relative to the body case, wherein the position of the spring catch is adjusted thereby to adjust the biasing force of the compression spring sandwiched between the first slider and the spring catch.

5. The door opening and closing device of claim 1, wherein the second slider is removably connected to the damper, and the second slider and the damper are away from each other so as to prevent the damper from damping rotation of the retractable arm when the retractable arm is rotated in the opening direction.

6. The door opening and closing device of claim 1, wherein the body case has at least one opening, the door opening and closing device further comprises an arm base having a first wall part which is installed in the body case via the opening for supporting an end of the arm axis, a second wall part for supporting an opposite end of the arm axis and a linking part for linking the first wall part to the second wall part, and the retractable arm is sandwiched between the first wall part and the second wall part of the arm base.

7. The door opening and closing device of claim 6, wherein the opposite end of the arm axis is supported by the second wall part of the arm base and a side wall of the body case superimposed on the second wall part.

8. The door opening and closing device of claim 1, further comprising a second link which is connected to the retractable arm at an off-center position from the arm axis and is connected rotatable to the second slider.

9. The door opening and closing device of claim 1, wherein the biasing member is a compression spring.

10. The door opening and closing device of claim 2, wherein the biasing member is a compression spring.

11. The door opening and closing device of claim 2, wherein the second slider is removably connected to the damper, and the second slider and the damper are away from each other so as to prevent the damper from damping rotation of the retractable arm when the retractable arm is rotated in the opening direction.

12. The door opening and closing device of claim 3, wherein the second slider is removably connected to the damper, and the second slider and the damper are away from each other so as to prevent the damper from damping rotation of the retractable arm when the retractable arm is rotated in the opening direction.

13. The door opening and closing device of claim 4, wherein the second slider is removably connected to the damper, and the second slider and the damper are away from each other so as to prevent the damper from damping rotation of the retractable arm when the retractable arm is rotated in the opening direction.

* * * * *